US007070840B2

(12) United States Patent
Yamada et al.

(10) Patent No.: US 7,070,840 B2
(45) **Date of Patent: *Jul. 4, 2006**

(54) INKJET RECORDING SHEET

(75) Inventors: Hisao Yamada, Shizuoka-ken (JP); Kazuyuki Koike, Shizuoka-ken (JP); Ryoichi Nakano, Shizuoka-ken (JP); Yuichi Wakata, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 261 days.

This patent is subject to a terminal disclaimer.

(21) Appl. No.: 10/132,709

(22) Filed: Apr. 26, 2002

(65) Prior Publication Data

US 2003/0068476 A1 Apr. 10, 2003

(30) Foreign Application Priority Data

Apr. 27, 2001 (JP) ..... 2001-132124
Apr. 10, 2002 (JP) ..... 2002-108436

(51) Int. Cl.
*B41M 5/40* (2006.01)

(52) U.S. Cl. ..... 428/32.26; 428/32.28; 428/32.29; 428/32.3; 428/32.34

(58) Field of Classification Search ..... 428/32.26, 428/32.28, 32.29, 32.3, 32.34
See application file for complete search history.

(56) References Cited

U.S. PATENT DOCUMENTS

| | | | | |
|---|---|---|---|---|
| 4,879,166 | A * | 11/1989 | Misuda et al. | 428/212 |
| 5,011,816 | A | 4/1991 | Byers et al. | |
| 5,314,747 | A | 5/1994 | Malhotra et al. | |
| 5,411,787 | A | 5/1995 | Kulkarni et al. | |
| 5,451,458 | A | 9/1995 | Malhotra | |
| 5,457,486 | A | 10/1995 | Malhotra et al. | |
| 5,498,505 | A * | 3/1996 | Tsukahara et al. | 430/213 |
| 5,500,668 | A | 3/1996 | Malhotra et al. | |
| 5,663,212 | A * | 9/1997 | Wakata et al. | 522/75 |
| 5,707,716 | A | 1/1998 | Yoshino et al. | |
| 5,948,534 | A | 9/1999 | Altavilla | |
| 6,165,606 | A | 12/2000 | Kasahara et al. | |
| 6,177,181 | B1 | 1/2001 | Hamada et al. | |
| 6,214,458 | B1 | 4/2001 | Kobayashi et al. | |
| 6,242,082 | B1 * | 6/2001 | Mukoyoshi et al. | 428/32.18 |
| 6,395,459 | B1 | 5/2002 | Taylor et al. | |
| 6,455,136 | B1 | 9/2002 | Okajima et al. | |
| 6,482,503 | B1 | 11/2002 | Malhotra | |
| 6,492,005 | B1 * | 12/2002 | Ohbayashi et al. | 428/32.29 |
| 6,589,635 | B1 | 7/2003 | Suzuki et al. | |
| 6,613,419 | B1 | 9/2003 | Ohbayashi et al. | |
| 6,743,850 | B1 * | 6/2004 | Yoshimura et al. | 524/538 |
| 2001/0016249 | A1 | 8/2001 | Kitamura et al. | |
| 2002/0064633 | A1 * | 5/2002 | Wakata et al. | 428/195 |
| 2002/0140796 | A1 | 10/2002 | Sumioka et al. | |
| 2003/0026960 | A1 * | 2/2003 | Yamada et al. | 428/195 |
| 2004/0101640 | A1 * | 5/2004 | Tsujihata et al. | 428/32.1 |
| 2005/0003114 | A1 * | 1/2005 | Nakano et al. | 428/32.34 |

FOREIGN PATENT DOCUMENTS

| | | | |
|---|---|---|---|
| EP | 0 673 782 | A2 | 9/1995 |
| EP | 0 968 836 | A2 | 1/2000 |
| EP | 1 034 940 | A1 | 9/2000 |
| EP | 1 138 509 | A2 | 10/2001 |
| EP | 1 195 259 | A2 | 4/2002 |
| EP | 1 219 459 | A2 | 7/2002 |
| EP | 1 253 021 | A2 | 10/2002 |
| JP | 64-36479 | | 2/1989 |
| JP | 1-115677 | | 5/1989 |
| JP | 1-036479 | A1 | 7/1989 |
| JP | 8-13570 | | 2/1996 |
| JP | 8-22608 | | 3/1996 |
| JP | 2000-177241 | | 6/2000 |
| JP | 2000-263928 | | 9/2000 |
| JP | 2001-270220 | * | 2/2001 |
| JP | 2001-260519 | | 9/2001 |
| JP | 2001-270220 | | 10/2001 |

OTHER PUBLICATIONS

Patent Abstracts of Japan abstract of JP-A-11-348417 dated Dec. 21, 1999.

* cited by examiner

*Primary Examiner*—B. Shewareged
(74) *Attorney, Agent, or Firm*—Sughrue Mion, PLLC

(57) ABSTRACT

An inkjet recording sheet has a colorant-receiving layer on a support. The colorant-receiving layer is provided with at least one of compounds represented by the following formulas (1) to (4) and which has either or both of an I/O value of at least 0.5 and a water soluble property. The colorant-receiving layer is also provided with at least one organic mordant selected from polyallylamine, polyvinylamine and derivatives of these. In the formulas, each of $R^1$ to $R^7$ independently represents an alkyl group, an aryl group, or a heterocyclic group that may have a substituent, and any of pairs $R^1$ and $R^2$, $R^4$ and $R^5$, and $R^6$ and $R^7$ may be mutually coupled to form a ring $R^1—S—R^2$ General Formula (1)

$R^4—S—S—R^5$ General Formula (2)

$R^3—SH$ General Formula (3)

General Formula (4)

$$R^6—\overset{\overset{\displaystyle O}{\|}}{S}—R^7.$$

24 Claims, No Drawings

INKJET RECORDING SHEET

BACKGROUND OF THE INVENTION

1. Field of the Invention

The present invention relates to a recording subject material that is supplied to an inkjet recording process in which liquid ink, such as water-color ink (where dye or pigment is used as coloring material) and oil ink, or solid-state ink that is a solid substance at normal temperature, and melted and made into liquid so as to be used for printing, is adopted, and, more particularly, concerns an inkjet recording sheet that is superior in ink-receiving property and image-maintaining property.

2. Description of the Related Art

In recent years, along with the rapid development of the information technological industry, various information processing systems have been developed, and recording methods and recording apparatuses suitable for these information-processing systems have been developed, and put into practical use.

Among these recording methods, an inkjet recording method has come to be widely used in offices as well as at home because of its advantages in which various recording materials can be used, and hardware (apparatuses) is comparatively inexpensive and compact, and superior in the noiseless property.

Moreover, along with recent high-resolution inkjet printers, it becomes possible to obtain high-image-quality recordings that are close to photographs, and in accordance with the development of hardware (apparatuses), various recording sheets for use in inkjet printing have been developed.

With respect to characteristics required for recording sheets used for these inkjet recording processes, in general, the following points are listed: (1) quick drying property (great ink-absorbing rate), (2) proper, uniform ink-dot diameter (without causing bleeding), (3) good graininess, (4) high roundness in dots, (5) high color density, (6) high chromaticness (without subdued color), (7) high water-resisting property, light resisting property and ozone resisting property, (8) high whiteness degree in recording sheets, (9) superior shelf life in recording sheets (without causing after-yellowing even in the case of a long-time storage, without bleeding even after a long-time storage), (10) superior dimension stability without susceptibility to deformation (less susceptible to curling) and (11) good traveling property on hardware.

Moreover, with respect to the application of photographic gloss paper used for high image-quality recordings close to photographs, in addition to the above-mentioned various properties, other characteristics, such as gloss-applying property, surface-smoothness and texture of printing paper like silver salt photographs, are also required.

In order to improve the above-mentioned various properties, in recent years, inkjet recording sheets, which have a porous structure in the coloring-material receiving layer have been developed and put into practical use. Since the inkjet recording sheets of this type have the porous structure, they are superior in the ink-receiving property (quick drying property), and have a high gloss-applying property.

For example, Japanese Patent Application Laid-Open (JP-A) Nos. 10-119423 and 10-217601 have proposed inkjet recording sheets which have fine inorganic pigment particles and a water-soluble resin and are provided with a coloring-material receiving layer having a high porosity formed on the support thereof.

These recording sheets, in particular, inkjet recording sheets having a coloring-material receiving layer with a porous structure in which silica is used as inorganic pigment fine particles, have a superior ink-absorbing property and a high ink-receiving property for forming an image with high resolution because of their inherent structure, and also exhibit a high gloss-applying property.

The above-mentioned respective inkjet recording sheets have a superior ink-absorbing property and a high ink-receiving property for forming an image with high resolution because of their inherent structure, and also exhibit a high gloss-applying property. However, from the viewpoint of gloss-applying property and texture, since these recording sheets use a support with resin coat such as polyethylene applied on both of the surfaces thereof, a high-boiling-point solvent contained in the coloring-material receiving layer is not allowed to evaporate, and this solvent is hardly absorbed in the support. For this reason, the high-boiling-point solvent remains in the coloring-material receiving layer as it is, and when, after the printing process, the recording sheets are stored under high-temperature, high moisture environment for a long time, the solvent is dispersed together with the dye in the coloring-material receiving layer, causing age-based image bleeding (hereinafter, referred to as "age-based bleeding).

Here, with respect to the inkjet recording sheet, in order to fix dye components in the ink, a compound having amino-groups and ammonium salts, in particular, a polymer compound having these, is often added thereto.

For example, many compounds have been used, and examples thereof include: a (co)polymer of diallyl ammonium salt derivative disclosed in JP-A Nos. 60-83882, 64-75281 and 59-20696; a copolymer of allyl amine salt disclosed in JP-A Nos. 61-61887, 61-72581, etc.; (meth) acrylate, (meth)acryl amid type (co)polymers having an ammonium salt, and vinyl (co)polymer such as (co)polymers of vinyl benzyl ammonium salt disclosed in JP-A Nos. 6-340163, 4-288283, 9-300810, 8-318672, 10-272830, 63-115780, etc.; modified polyvinyl alcohol (PVA) disclosed in JP-A No. 10-44588; an amine-epichlorohydrine polyadded substance disclosed in JP-A Nos. 6-234268 and 11-277888; dihalide-diamine polyadded substance disclosed in JP-A No. 10-119418; and polyamidine disclosed in JP-A Nos. 11-58934 and 11-28860. By using these compounds, it is possible to fix dyes, and consequently to prevent bleeding.

However, since any of these compounds are basically water-soluble high polymers, it is not possible to completely fix the water-soluble dyes and to sufficiently prevent bleeding, in particular, under high-temperature, high-moisture environments.

Moreover, in the case when these sheets are stored in a clear file, etc., immediately after the printing process, since moisture in the ink and high-boiling-point solvents (glycerin, diethyl glycol derivatives, etc.), slightly contained in the ink, are still allowed to remain, age-based bleeding tends to occur in this case also.

Moreover, as disclosed in JP-A Nos. 57-36692, 10-180034, 11-20302 and 8-244336, inkjet recording sheets have been known in which, an amino group and an ammonium salt are contained in the same manner as the above-mentioned compounds and a water-insoluble base latex is also contained. In the inkjet recording sheet of this type, the application of this hydrophobic latex makes it possible to improve the water resisting property.

However, in order to provide a sufficient water resisting property in the inkjet recording sheets using such latex having a hydrophobic property, a great amount of the hydrophobic latex needs to be added. The resulting problems are degradation in light resistance in images and degradation in the miscibility to pigments.

Many of these substances use a crosslinking monomer (that is, a monomer having not less than two polymerizing functional groups in a molecule) in order to form a hydrophilic monomer unit such as an amino group and ammonium salt into latex. For this reason, water-soluble ink is hardly allowed to permeate into these particles, and the ink receiving property is not sufficient. Moreover, since a particulate compound is added, this plugs voids of the porous film when applied to a receiving layer made of a porous film, resulting in degradation in the ink absorbing property. Moreover, it is not possible to prevent the generation of age-based bleeding even when these compounds are used.

Moreover, trace gases in the air such as ozone, in particular, cause age-based fading in recorded images. In particular, since the recording material having a receiving layer of a porous structure contains many voids, resistance to ozone in the air is required.

JP-A No. 2000-177235 has proposed an inkjet recording medium containing Mg ions and SCN ions in a porous layer containing an alumina hydrate. Since Mg ions and SCN ions are contained in the porous layer, this inkjet recording medium has improved light resistant and ozone resisting properties. However, the above-mentioned inkjet recording medium has a problem in which, although the above-mentioned properties are improved, it is not possible to simultaneously prevent the generation of age-based bleeding. Moreover, it has been known that in the case of the application of Ca ions instead of Mg ions, there is degradation in the ink absorbing property.

JP-A No. 7-314882 has disclosed a recording sheet having a porous ink-receiving layer containing at least one compound selected from the group consisting of dithiocarbamate, thiuram salt, thiocyanic acid esters, thiocyanates, and hindered amine compounds. With respect to specific examples of the hindered amine compounds, a compound having a structure in which all the hydrogen atoms on carbons in second and sixth positions of piperidine are substituted by methyl groups is listed, and in this recording sheet, by containing not less than one compound of the above-mentioned compound, it is possible to prevent fading in recorded images due to trace gases in the air.

However, in the above-mentioned Patent Application, no description has been given with respect to combinations of these compounds and mordants. These recording sheets have degradation in the age-based bleeding and fail to provide sufficient effects in improving endurance, in particular, in endurance for long-term use.

Moreover, JP-A Nos. 2000-255157, 2000-255158 and 2000-255160 have disclosed an inkjet recording medium containing at least one member selected from the group consisting of reducing agents having an aromatic ring. Specific examples of the reducing agents having the aromatic ring, compounds in which not less than two functional groups such as hydroxyl groups, amino groups, monoalkyl amino groups, etc., are coupled to a benzene nucleus or a naphthalene nucleus are listed. By containing these compounds, the above-mentioned recording medium makes it possible to improve image preserving property in recorded images, and consequently to prevent fading.

However, even in these recording sheets and recording media, although it is possible to provide improvements in age-based fading in the recorded images, it is not possible to sufficiently suppress the generation of age-based bleeding, and another problem is that coloring on paper surface (discoloration in white base portions), which is probably caused by these additive agents, tends to occur.

Moreover, it has been known that a sulfur-containing compound is used as an antioxidant. For example, Japanese Patent Application Publication (JP-B) Nos. 8-22608, JP-A No. 64-36479, JP-B No. 8-13570, JP-A Nos. 1-115677, 2000-177241, 2001-270220, have disclosed thioether-based compounds and mercaptobenzimidazole-based compounds that are used as sulfur-based antioxidants. However, any of the exemplified compounds are low-polarity compounds (less than 0.5 in I/O value), and the resulting problem is that it is not possible to provide sufficient effects in improving endurance even in the case of the application of these.

JP-A No. 2000-263928 has also disclosed an example in which various sulfur-based compounds are used, with high-polarity compounds (not less than 0.5 in I/O value), such as 3,6-dithiooctane-1,8-diol and thiosalicylic acid, being listed. However, in these examples, the compounds are limited to a combination of alkylene polyamine-dicyandiamide-based polycondensation substances; and the resulting problem is that these examples fail to prevent age-based bleeding.

JP-A No.7-257019 has disclosed ethylene thiourea, thiohydantoin, etc. used as a heterocyclic-ring compound, and JP-A No. 7-314883 has disclosed sulfur-containing compounds such as thiourea derivatives, thiosemicarbazide derivatives and thiocarbohydrazide derivatives. However, these examples have not disclosed anything about effects on the prevention of fading. Moreover, these examples have not described anything about combinations between these compounds and mordants.

These recording sheets fail to prevent age-based bleeding and to provide sufficient effects in improving endurance.

JP-B No.4-34953 has disclosed that the addition of a compound, such as a thiourea-based compound, a thiosemicarbazide compound and a thiocarbohydrazide-based compound, makes it possible to improve the endurance. Moreover, this has also disclosed an example in which a thiourea-based compound is combined with an organic mordant. However, there is a description that a preferable mordant to be combined therewith is quaternary ammonium salt compound, and this type of combinations fails to prevent age-based bleeding and to provide sufficient effects in improving endurance.

Furthermore, JP-A No. 2001-260519 has disclosed a recording sheet having a porous ink-receiving layer containing at least one compound of compound selected from the group consisting of a sulfinic acid compound, a thiosulfinic acid compound and a thiosulfonic acid compound. This has also disclosed that at least one compound selected from the group consisting of a thiourea compound, saccharides, a pyridine-based compound, a thioether-based compound, disulfide-based compound and a thiazine-based compound, is combined with the above-mentioned compound, and contained therein so that it is possible to greatly improve the image-preserving property. Further, these gazettes have also described that a cationic compound may be combinedly used, with polymers having primary to tertiary amino groups and quaternary ammonium salt group being exemplified. However, the compounds disclosed in Examples are only polymers having quaternary ammonium salt groups; and these cause age-based bleeding, degradation in light resisting property and ozone resisting property, thereby failing to provide sufficient effects in improving the endurance. Moreover, no description has been given with respect to the effects for improving endurance derived from the difference in kinds of these cationic polymers.

As described above, at present, an inkjet recording sheet, which has a firm colorant-receiving layer that is less susceptible to cracks, etc., is provided with a superior ink-absorbing property, a surface-smoothing property and a gloss-applying property on its recording surface, and makes it possible to form an image with high resolution, with high density, while maintaining a high ink-receiving property so that the resulting image has high light resisting property and water resisting property, and which makes it possible to store images without causing age-based bleeding even when, after the printing operation, the sheets have been stored for a long time under high temperature, high moisture environments, and has a superior ozone resisting property to prevent age-based fading in image recordings, has not been presented yet.

SUMMARY OF THE INVENTION

The present invention has been provided to solve the above-mentioned conventional problems, and its subject is to achieve the following objects.

One of the objects is to provide an inkjet recording sheet which has a surface smoothness and a gloss-applying property on a recording surface with a firm structure that is less susceptible to cracks, etc., is provided with a superior ink-absorbing property, makes it possible to form an image with high resolution, with high density, without causing age-based bleeding even when, also has image-endurance properties such as a light resistant property, a water resisting property and an ozone resisting property, and is free from coloring, etc. on the paper surface.

The inventors have studied hard, and have found that, when at least one compound selected from the group consisting of specific sulfur-containing compounds is contained in a colorant-receiving layer in combination with an organic mordant that is at least one compound selected from the group consisting of polyallylamine, polyvinylamine and derivatives thereof, and when a specific thioether-based compound is contained in the colorant-receiving layer, it becomes possible to achieve the above-mentioned object, thereby achieving the present invention.

Therefore, the above-mentioned object is achieved by the following means:

According to a first aspect of the present invention, there is provided an inkjet recording sheet comprising a support and, on the support, a colorant-receiving layer including: (A) at least one compound selected from the group consisting of compounds represented by the following formulas (1) to (4), the compound having an I/O value, which is an inorganic/organic ratio in an organic conceptual chart, of not less than 0.5; and (B) at least one organic mordant selected from the group consisting of polyallylamine, polyvinylamine and derivatives thereof:

$R^1—S—R^2$ General Formula (1)

$R^4—S—S—R^5$ General Formula (2)

$R^3—SH$ General Formula (3)

General Formula (4)

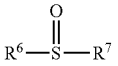

wherein, in formulas (1) to (4), each of $R^1$, $R^2$, $R^3$, $R^4$, $R^5$, $R^6$ and $R^7$ independently represents an optionally substituted alkyl group, an optionally substituted aryl group or an optionally substituted heterocyclic group, and any of pairs $R^1$ and $R^2$, $R^4$ and $R^5$, and $R^6$ and $R^7$ may be mutually coupled to form a ring.

According to a second aspect of the present invention, there is provided an inkjet recording sheet comprising a support and, on the support, a colorant-receiving layer including: (A) at least one compound selected from the group consisting of compounds represented by the following formulas (1) to (4), the compound being substantially water soluble; and (B) at least one organic mordant selected from the group consisting of polyallylamine, polyvinylamine and derivatives thereof:

$R^1—S—R^2$ General Formula (1)

$R^4—S—S—R^5$ General Formula (2)

$R^3—SH$ General Formula (3)

General Formula (4)

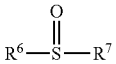

wherein, in formulas (1) to (4), each of $R^1$, $R^2$, $R^3$, $R^4$, $R^5$, $R^6$ and $R^7$ independently represents an optionally substituted alkyl group, an optionally substituted aryl group or an optionally substituted heterocyclic group, and any of pairs $R^1$ and $R^2$, $R^4$ and $R^5$, and $R^6$ and $R^7$ may be mutually coupled to form a ring.

A third aspect of the present invention provides the inkjet recording sheet according to the first aspect, wherein at least one of $R^1$ and $R^2$, at least one of $R^4$ and $R^5$, or at least one of $R^6$ and $R^7$ is substituted, the substituent including at least one substituent selected from the group consisting of a hydroxyl group, a carboxyl group, a carboxylate, an amino group, a sulfonic acid group and a sulfonate.

A fourth aspect of the present invention provides the inkjet recording sheet according to the second aspect, wherein at least one of $R^1$ and $R^2$, at least one of $R^4$ and $R^5$, or at least one of $R^6$ and $R^7$ is substituted, the substituent including at least one substituent selected from the group consisting of a hydroxyl group, a carboxyl group, a carboxylate, an amino group, a sulfonic acid group and a sulfonate.

A fifth aspect of the present invention provides the inkjet recording sheet according to the first aspect, wherein the colorant-receiving layer further comprises at least one compound selected from the group consisting of compounds represented by the following formulas (5), (6) and (7) and compounds including an aliphatic carbon-carbon double bond group:

General Formula (5)

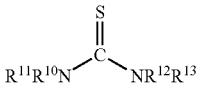

General Formula (6)

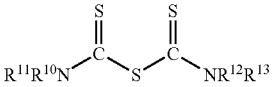

-continued

General Formula (7)

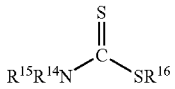

wherein: in formulas (5) and (6), each of $R^{10}$, $R^{11}$, $R^{12}$ and $R^{13}$ independently represents a hydrogen atom, an amino group, a substituted or unsubstituted alkyl group, a substituted or unsubstituted aryl group, an acyl group or an alkoxycarbonyl group, and any pair from $R^{10}$, $R^{11}$, $R^{12}$ and $R^{13}$ may be coupled to each other to form a ring; and in formula (7), each of $R^{14}$ and $R^{15}$ independently represents a hydrogen atom, a substituted or unsubstituted alkyl group, a substituted or unsubstituted aryl group, an acyl group or an alkoxycarbonyl group, $R^{16}$ represents a hydrogen atom, a substituted or unsubstituted alkyl group, a substituted or unsubstituted aryl group, a metal or quaternary ammonium, and any pair from $R^{14}$, $R^{15}$ and $R^{16}$ may be coupled to each other to form a ring.

A sixth aspect of the present invention provides the inkjet recording sheet according to the second aspect, wherein the colorant-receiving layer further comprises at least one compound selected from the group consisting of compounds represented by the following formulas (5), (6) and (7) and compounds including an aliphatic carbon-carbon double bond group:

General Formula (5)

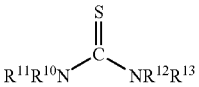

General Formula (6)

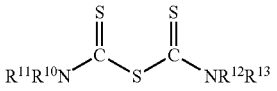

General Formula (7)

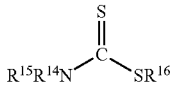

wherein: in formulas (5) and (6), each of $R^{10}$, $R^{11}$, $R^{12}$ and $R^{13}$ independently represents a hydrogen atom, an amino group, a substituted or unsubstituted alkyl group, a substituted or unsubstituted aryl group, an acyl group or an alkoxycarbonyl group, and any pair from $R^{10}$, $R^{11}$, $R^{12}$ and $R^{13}$ may be coupled to each other to form a ring; and in formula (7), each of $R^{14}$ and $R^{15}$ independently represents a hydrogen atom, a substituted or unsubstituted alkyl group, a substituted or unsubstituted aryl group, an acyl group or an alkoxycarbonyl group, $R^{16}$ represents a hydrogen atom, a substituted or unsubstituted alkyl group, a substituted or unsubstituted aryl group, a metal or quaternary ammonium, and any pair from $R^{14}$, $R^{15}$ and $R^{16}$ may be coupled to each other to form a ring.

A seventh aspect of the present invention provides the inkjet recording sheet according to the first aspect, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

An eighth aspect of the present invention provides the inkjet recording sheet according to the second aspect, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

A ninth aspect of the present invention provides the inkjet recording sheet according to the first aspect, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

A tenth aspect of the present invention provides the inkjet recording sheet according to the second aspect, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

An eleventh aspect of the present invention provides the inkjet recording sheet according to the first aspect, wherein the colorant-receiving layer further comprises fine particles, which include at least one selected from the group consisting of silica fine particles, colloidal silica, alumina fine particles and pseudo-boehmite.

A twelfth aspect of the present invention provides an inkjet recording sheet according to the second aspect, wherein the colorant-receiving layer further comprises fine particles, which include at least one selected from the group consisting of silica fine particles, colloidal silica, alumina fine particles and pseudo-boehmite.

A thirteenth aspect of the present invention provides an inkjet recording sheet according to the eleventh aspect, wherein the colorant-receiving layer comprises a layer formed by a process including the steps of: coating a coating solution containing at least fine particles, the water soluble resin and the cross-linking agent, for forming a coated layer; drying the coated layer; and cross-linking and curing the coated layer by applying a basic solution having a pH value of not less than 8 to the coated layer or a coating film, at at least one time of (1) simultaneously with the step of coating the coating solution and (2) during the step of drying the coated layer, before the coated layer exhibits a decreasing rate of drying.

A fourteenth aspect of the present invention provides an inkjet recording sheet according to the twelfth aspect, wherein the colorant-receiving layer comprises a layer formed by a process including the steps of: coating a coating solution containing at least fine particles, the water soluble resin and the cross-linking agent, for forming a coated layer; drying the coated layer; and cross-linking and curing the coated layer by applying a basic solution having a pH value of not less than 8 to the coated layer or a coating film, at at least one time of (1) simultaneously with the step of coating the coating solution and (2) during the step of drying the coated layer, before the coated layer exhibits a decreasing rate of drying.

According to a fifteenth aspect of the present invention, there is provided an inkjet recording sheet comprising a support and, on the support, a colorant-receiving layer including at least one compound selected from the group consisting of thioether-based compounds represented by the following formula (8), the compound having an I/O value, which is an inorganic/organic ratio in an organic conceptual chart, of not less than 0.5:

$$X—(Y^1—S)_m—(Y^2—S)_n—Y^3—X \quad \text{General Formula (8)}$$

wherein, in the formula (8): X represents a hydroxyl group, a carboxyl group, a carboxylate, an amino group, or a group including at least one of these groups; $Y^1$, $Y^2$ and $Y^3$ each independently represents an alkylene group; n represents an integer from 1 to 6; and m represents 0 or 1.

According to a sixteenth aspect of the present invention, there is provided an inkjet recording sheet comprising a support and, on the support, a colorant-receiving layer including at least one compound selected from the group consisting of thioether-based compounds represented by the following formula (8), the compound being substantially water soluble:

$$X—(Y^1—S)_m—(Y^2—S)_n—Y^3—X \quad \text{General Formula (8)}$$

wherein, in the formula (8): X represents a hydroxyl group, a carboxyl group, a carboxylate, an amino group, or a group including at least one of these groups; $Y^1$, $Y^2$ and $Y^3$ each independently represents an alkylene group; n represents an integer from 1 to 6; and m represents 0 or 1.

A seventeenth aspect of the present invention provides the inkjet recording sheet according to the fifteenth aspect, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

An eighteenth aspect of the present invention provides the inkjet recording sheet according to the sixteenth aspect, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

A nineteenth aspect of the present invention provides the inkjet recording sheet according to the fifteenth aspect, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

A twentieth aspect of the present invention provides the inkjet recording sheet according to the sixteenth aspect, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

A twenty-first aspect of the present invention provides the inkjet recording sheet according to the fifteenth aspect, wherein the colorant-receiving layer further comprises fine particles, which include at least one selected from the group consisting of silica fine particles, colloidal silica, alumina fine particles and pseudo-boehmite.

A twenty-second aspect of the present invention provides an inkjet recording sheet according to the sixteenth aspect, wherein the colorant-receiving layer further comprises fine particles, which include at least one selected from the group consisting of silica fine particles, colloidal silica, alumina fine particles and pseudo-boehmite.

A twenty-third aspect of the present invention provides an inkjet recording sheet according to the twenty-first aspect, wherein the colorant-receiving layer comprises a layer formed by a process including the steps of: coating a coating solution containing at least fine particles, the water soluble resin and the cross-linking agent, for forming a coated layer; drying the coated layer; and cross-linking and curing the coated layer by applying a basic solution having a pH value of not less than 8 to the coated layer or a coating film, at at least one time of (1) simultaneously with the step of coating the coating solution and (2) during the step of drying the coated layer, before the coated layer exhibits a decreasing rate of drying.

A twenty-fourth aspect of the present invention provides an inkjet recording sheet according to the twenty-second aspect, wherein the colorant-receiving layer comprises a layer formed by a process including the steps of: coating a coating solution containing at least fine particles, the water soluble resin and the cross-linking agent, for forming a coated layer; drying the coated layer; and cross-linking and curing the coated layer by applying a basic solution having a pH value of not less than 8 to the coated layer or a coating film, at at least one time of (1) simultaneously with the step of coating the coating solution and (2) during the step of drying the coated layer, before the coated layer exhibits a decreasing rate of drying.

DESCRIPTION OF THE PREFERRED EMBODIMENTS (Inkjet Recording Sheet)

The following description will discuss an inkjet recording sheet of the present invention in detail.

The inkjet recording sheet of the present invention has a colorant-receiving layer on a support. The colorant-receiving layer comprises (A) at least one compound selected from the group consisting of compounds represented by the following formulas (1) to (4), the compound being set to have an inorganic/organic ratio of not less than 0.5 in an organic conceptual chart (I/O value), and (B) at least one organic mordant selected from the group consisting of polyallylamine, polyvinylamine and derivatives of these, and the colorant-receiving layer may further comprises an acidic compound, inorganic file particles, a water soluble resin, a cross-linking agent for the water soluble resin, if necessary.

<Compounds Represented by Formulas (1) to (4)>

First, the following description will discuss the compounds represented by the following formulas (1) to (4).

$$R^1—S—R^2 \quad \text{General Formula (1)}$$

$$R^4—S—S—R^5 \quad \text{General Formula (2)}$$

$$R^3—SH \quad \text{General Formula (3)}$$

General Formula (4)

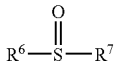

In formulas (1) to (4), each of $R^1$ to $R^7$ independently represents an alkyl group that may have a substituent, an aryl group that may have a substituent or a heterocyclic group that may have a substituent, and any of pairs $R^1$ and $R^2$, $R^4$ and $R^5$, and $R^6$ and $R^7$ may be mutually coupled to form a ring.

With respect to the alkyl group represented by $R^1$ to $R^7$, examples thereof include linear or branched alkyl groups, and the number of carbon atoms thereof is preferably set to 1 to 20, more preferably, 1 to 12. With respect to such alkyl groups, examples thereof include: methyl group, ethyl group, n-propyl group, i-propyl group, n-butyl group, i-butyl group, sec-butyl group, t-butyl group, n-pentyl group, n-hexyl group and 2-ethylhexyl group, and among these, groups such as methyl group, ethyl group, n-propyl group and i-propyl group are preferably used.

Moreover, in the case when the alkyl group represented by $R^1$ to $R^7$ has a substituent, examples of the substituent include a hydroxyl group, a carboxyl group, a sulfonic acid group, and an amino group; and among these, a hydroxyl group and a carboxyl group are preferably used.

With respect to the aryl group represented by $R^1$ to $R^7$, the number of carbon atoms is preferably set to 6 to 20, more preferably, 6 to 12. Examples of such aryl groups include a phenyl group, a naphthyl group and anthoranyl group, and among these, a phenyl group is preferably used.

Moreover, in the case when the aryl group represented by $R^1$ to $R^7$ has a substituent, examples of the substituent include a hydroxyl group, a thiol group, a methyl group and a t-butyl group, and among these, a hydroxyl group and a thiol group are preferably used.

Examples of heterocyclic groups represented by $R^1$ to $R^7$ include groups containing nitrogen, oxygen or sulfur atoms. The total number of carbon, nitrogen, sulfur, oxygen atoms in the group is preferably from 1 to 20, and particularly preferably from 1 to 12.

Examples of such heterocyclic groups include, for example, a furyl group, a thienyl group, a pyridyl group, a pyrazolyl group, an isooxazolyl group, an isothiazolyl group, an imidazolyl group, an oxazolyl group, a thiazolyl group, a pyridazyl group, a pyrimidyl group, a pyrazyl group, a triazolyl group, a tetrazolyl group, a quinolyl group, a benzothiazolyl group, a benzooxazolyl group, a benzoimidazolyl group, an isoquinolyl group, a thiadiazolyl group, a morpholino group, a piperidino group, a piperazino group, an indolyl group, an isoindolyl group and the like. These heterocyclic groups may have a substituent. Examples of this substituent include the examples presented above in regard to the substituent of the alkyl group.

Of these preferable heterocyclic groups, the furyl group, the thienyl group, the pyridyl group, the morpholino group, the piperidino and the like are more preferable.

The compounds, represented by the above-mentioned formulas (1) to (4), are preferably set to have a water soluble property, and when the compound has a water soluble property, it is possible to obtain the effects of an ozone resisting property and a light resisting property more easily.

Moreover, at least one of the above-mentioned $R^1$ and $R^2$, at least one of the above-mentioned $R^4$ and $R^5$, or at least one of the above-mentioned $R^6$ and $R^7$ is preferably set to have a substituent, and the substituent is at least one member selected from the group consisting of a hydroxyl group, a carboxyl group, a carboxylate, an amino group, a sulfonic acid group and a sulfonate, and among these, a hydroxyl group, a carboxyl group and a carboxylate are more preferably used.

The following description will discuss preferable specific examples (1–1 to 1–100) of compounds represented by the above-mentioned formulas (1) to (4); however, the present invention is not intended to be limited by these.

(1-1)

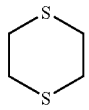

I/O = 0.75

(1-2)

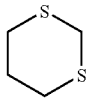

I/O = 0.75

(1-3)

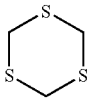

I/O = 1.08

(1-4)

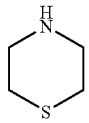

I/O = 1.20

(1-5)

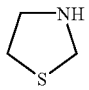

I/O = 1.50

(1-6)

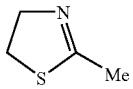

I/O = 1.22

(1-7)

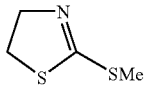

I/O = 1.22

(1-8)

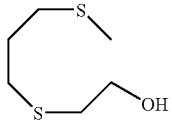

I/O = 1.13

(1-9)

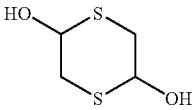

I/O = 2.42

-continued
(1-10)
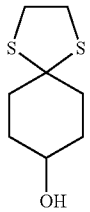
I/O = 1.0
(1-11)
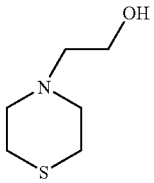
I/O = 1.57
(1-12)
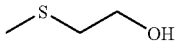
I/O = 1.75
(1-13)
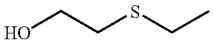
I/O = 1.4
(1-14)
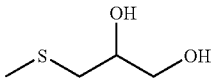
I/O = 2.40
(1-15)
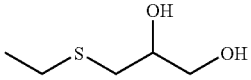
I/O = 2.00
(1-16)
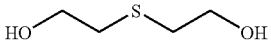
I/O = 2.40
(1-17)
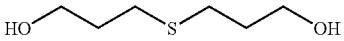
I/O = 1.71
(1-18)
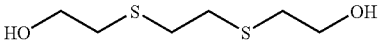
I/O = 1.75
(1-19)
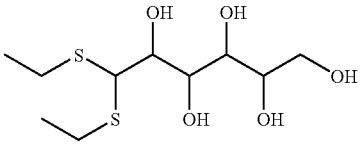
I/O = 2.42
(1-20)
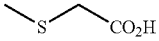
I/O = 2.38
(1-21)
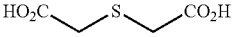
I/O = 3.40
-continued
(1-22)
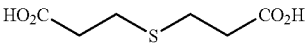
I/O = 2.43
(1-23)
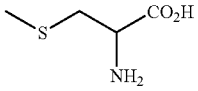
I/O = 2.60
(1-24)
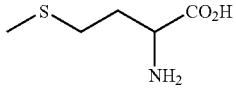
I/O = 2.17
(1-25)
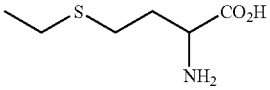
I/O = 1.86
(1-26)
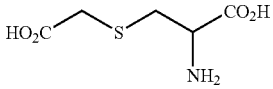
I/O = 3.42
(1-27)
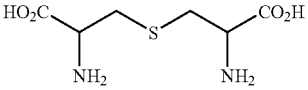
I/O = 3.43
(1-28)
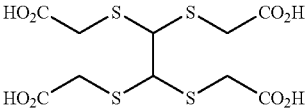
I/O = 2.71
(1-29)
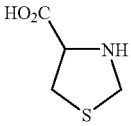
I/O = 2.70
(1-30)
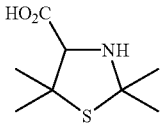
I/O = 1.50
(1-31)
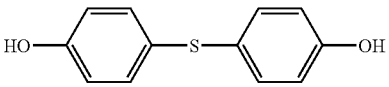
I/O = 1.04
(1-32)
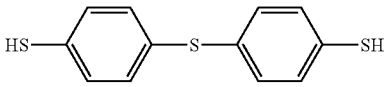
I/O = 0.50

-continued
(1-33)
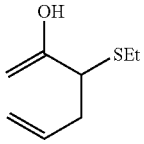
I/O = 0.80
(1-34)
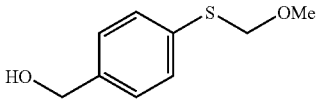
I/O = 0.88
(1-35)
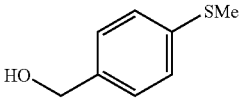
I/O = 0.86
(1-36)
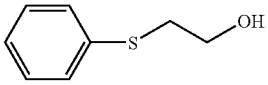
I/O = 0.86
(1-37)
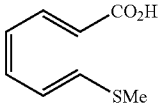
I/O = 1.22
(1-38)
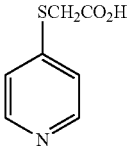
I/O = 1.72
(1-39)
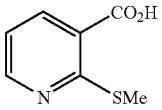
I/O = 1.72
(1-40)
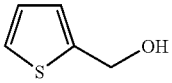
I/O = 1.28
(1-41)
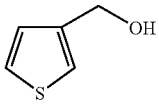
I/O = 1.28
(1-42)
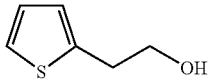
I/O = 1.10
(1-43)
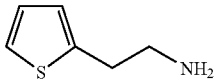
I/O = 0.89
(1-44)
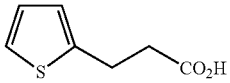
I/O = 1.28
(1-45)
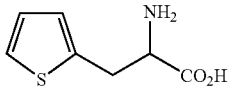
I/O = 1.71
(1-46)
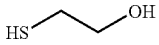
I/O = 2.33
(1-47)
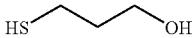
I/O = 1.75
(1-48)
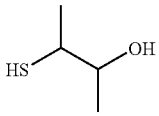
I/O = 1.40
(1-49)
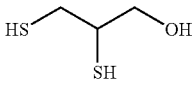
I/O = 1.80
(1-50)
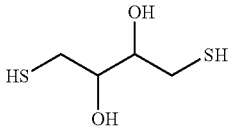
I/O = 2.33
(1-51)
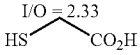
I/O = 3.17
(1-52)
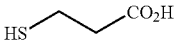
I/O = 2.38
(1-53)
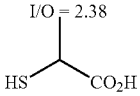
I/O = 2.38
(1-54)
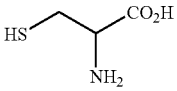
I/O = 3.25

-continued
(1-55)
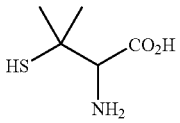
I/O = 2.17
(1-56)
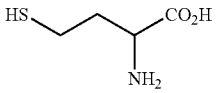
I/O = 2.60
(1-57)
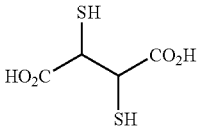
I/O = 3.17
(1-58)
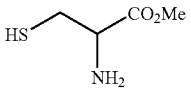
I/O = 1.70
(1-59)
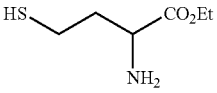
I/O = 1.21
(1-60)
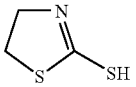
I/O = 1.40
(1-61)
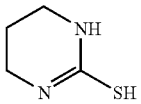
I/O = 1.70
(1-62)
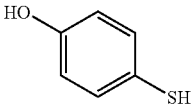
I/O = 1.11
(1-63)
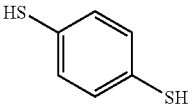
I/O = 0.59
(1-64)
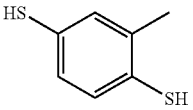
I/O = 0.53
-continued
(1-65)
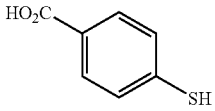
I/O = 1.28
(1-66)
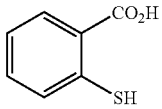
I/O = 1.28
(1-67)
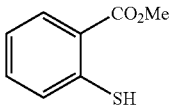
I/O = 0.64
(1-68)
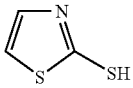
I/O = 1.42
(1-69)
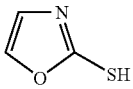
I/O = 1.53
(1-70)
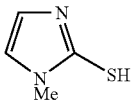
I/O = 1.72
(1-71)
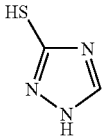
I/O = 3.67
(1-72)
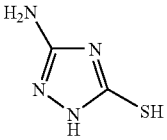
I/O = 4.83
(1-73)
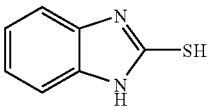
I/O = 1.16
(1-74)
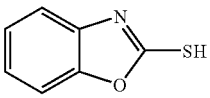
I/O = 0.84

-continued
(1-75)
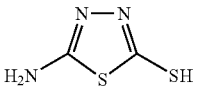
I/O = 3.25
(1-76)
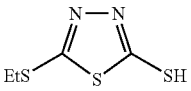
I/O = 2.14
(1-77)
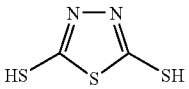
I/O = 3.00
(1-78)
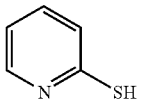
I/O = 1.04
(1-79)
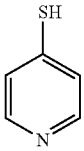
I/O = 1.04
(1-80)
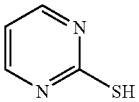
I/O = 1.95
(1-81)
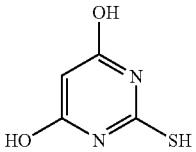
I/O = 3.95
(1-82)
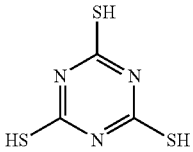
I/O = 4.54
(1-83)
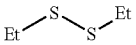
I/O = 0.67
(1-84)
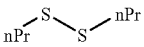
I/O = 0.50
(1-85)
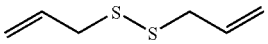
I/O = 0.53
-continued
(1-86)
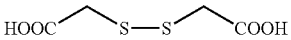
I/O = 3.17
(1-87)
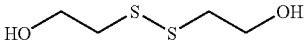
I/O = 2.33
(1-88)
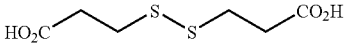
I/O = 2.38
(1-89)
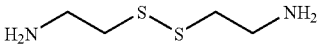
I/O = 1.83
(1-90)
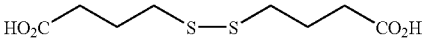
I/O = 1.90
(1-91)
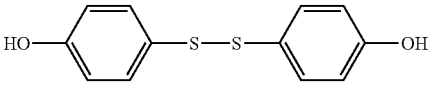
I/O = 1.11
(1-92)
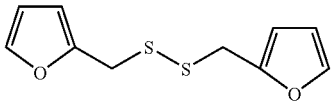
I/O = 0.62
(1-93)
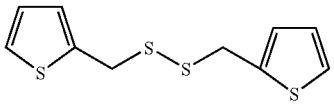
I/O = 0.67
(1-94)
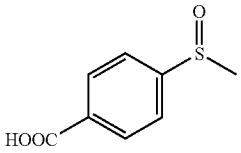
I/O = 0.68
(1-95)
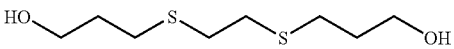
I/O = 1.40
(1-96)
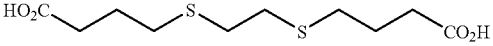
I/O = 1.58
(1-97)
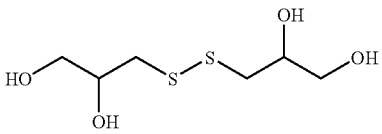
I/O = 3.00

-continued (1-98)

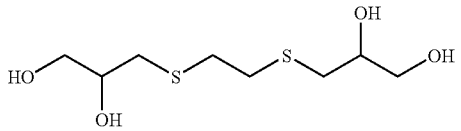

I/O = 2.40

(1-99)

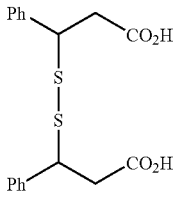

I/O = 1.03

(1-100)

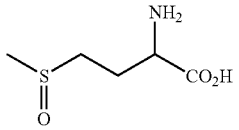

I/O = 1.08

The content of each of the compounds represented by the above-mentioned formula (1) to (4) is preferably set in the range of 0.01 g/m$^2$ to 5 g/m$^2$, more preferably, 0.05 g/m$^2$ to 3 g/m$^2$. From the viewpoint of the ozone resisting property, water resisting property and age-based bleeding, the above-mentioned content is preferably set in the range of 0.01 g/m$^2$ to 5 g/m$^2$.

The I/O value of the compound represented by the above-mentioned formulas (1) to (4) is preferably set to not less than 0.5, more preferably, 1.0 to 5.0. Here, the I/O value is a parameter representing the degree of lipophilic property/hydrophilic property of a compound or a substituent, and the detailed description thereof has been given in "Organic Conceptual Chart" (written by Yoshio Khoda, published by Sankyo Publishing Co., 1984). In this value, I represent an inorganic property while O represents an organic property, and the greater the I/O value, the higher the inorganic property.

The following description will discuss specific examples of the I/O value.

With respect to typical examples of I values a —NHCO— group is 200, a —$NHSO_2$— is 240, and a —COO— group is 60. For example, in the case of —$NHCOC_5H_{11}$, the number of carbon atoms is 6, and the O value is given by 20×6=120. Since I=200, I/O ≈1.67.

<Compounds Represented by Formulae (5) to (7)>

Moreover, in the inkjet recording sheet of the present invention, the above-mentioned colorant-receiving layer further contains at least one compound selected from the group consisting of compounds represented by the following formulas (5), (6) and (7), or at least one kind of compounds having an aliphatic carbon-carbon double bond group.

General Formula (5)

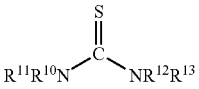

-continued

General Formula (6)

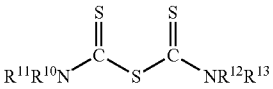

General Formula (7)

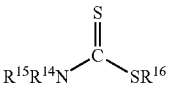

In formulas (5) and (6), each of $R^{10}$, $R^{11}$, $R^{12}$ and $R^{13}$ independently represents a hydrogen atom, an amino group, a substituted or unsubstituted alkyl group, a substituted or unsubstituted aryl group, an acyl group or an alkoxycarbonyl group, and any pair from $R^{10}$, $R^{11}$, $R^{12}$ and $R^{13}$ may be coupled to each other to form a ring; and in formula (7), each of $R^{14}$ and $R^{15}$ independently represents a hydrogen atom, a substituted or unsubstituted alkyl group, a substituted or unsubstituted aryl group, an acyl group or an alkoxycarbonyl group, $R^{16}$ represents a hydrogen atom, a substituted or unsubstituted alkyl group, a substituted or unsubstituted aryl group, a metal or quaternary ammonium, and any pair from $R^{14}$, $R^{15}$ and $R^{16}$ may be coupled to each other to form a ring.

With respect to the non-substituting alkyl group represented by $R^{10}$, $R^{11}$, $R^{12}$, $R^{13}$, $R^{14}$, $R^{15}$ and $R^{16}$, alkyl groups having carbon atoms of 1 to 22 are preferably used; and specific examples include methyl group, ethyl group, n-propyl group, n-butyl group, n-hexyl group, n-octyl group, benzyl group, hexadecyl group, i-propyl group, i-butyl group, sec-butyl group, t-butyl group and 2-ethylhexyl group; and among these, alkyl groups having carbon atoms of 1 to 10 are preferably used, and methyl group, n-butyl group, ethyl group, n-propyl group, i-butyl group and 2-ethylhexyl group are more preferably used.

Moreover, with respect to the above-mentioned substituting alkyl group, preferable examples include hydroxyl group, amino group, carboxy group, carbamoyl group, sulfoxy group, sulfomoyl group, halogen atom and phenyl group; and among these, hydroxy group, amino group, carboxy group and sulfoxy group are more preferably used.

With respect to the non-substituting aryl group represented by $R^{10}$, $R^{11}$, $R^{12}$, $R^{13}$, $R^{14}$, $R^{15}$ and $R^{16}$, for example, aryl groups having carbon atoms of 2 to 22 are preferably used; and specific examples thereof include phenyl group, 1-naphthyl group, 2-naphtyl group, 2-imidazolyl group, 2-thiozolyl group, 2-oxazolyl group, 2-pyridyl group, 3-pyridyl group and 4-pyridyl group. Among these, the aryl groups having carbon atoms of 4 to 10 are more preferably used; and in particular, phenyl group, 2-naphthyl group and 2-pyridyl group are most preferably used.

Moreover, with respect to the above-mentioned substituting aryl group, preferable examples include alkyl group, alkoxyl group, carboxy group, carbamoyl group, sulfoxy group, sulfomoyl group, halogen atom and phenyl group; and among these, alkoxy group and phenyl group are more preferably used.

With respect to the acyl group represented by $R^{10}$, $R^{11}$, $R^{12}$, $R^{13}$, $R^{14}$, $R^{15}$ and $R^{16}$, for example, acyl groups having carbon atoms of 3 to 22 are preferably used; and specific examples thereof include acetyl group, propanoyl group, n-butanoyl group, n-hexanoyl group, n-octanoyl group, 2-ethyl-hexanoyl group, benzoyl group, p-hydroxybenzoyl group and p-methoxybenzoyl group. Among these, the acyl groups having carbon atoms of 2 to 12 are more preferably used; and in particular, acetyl group and benzoyl group are most preferably used.

With respect to the alkoxycarbonyl group represented by $R^{10}$, $R^{11}$, $R^{12}$, $R^{13}$, $R^{14}$, $R^{15}$ and $R^{16}$, for example, alkoxycarbonyl groups having carbon atoms of 2 to 22 are preferably used; and specific examples thereof include methoxycarbonyl group, ethoxycarbonyl group, n-propyloxycarbonyl group, 2-hydroxyethoxycarbonyl group, vinyloxycarbonyl group, 2-propenyloxycarbonyl group, acetylcarbonyl group and phenoxycarbonyl group. Among these, the alkoxy carbonyl groups having carbon atoms of 2 to 12 are more preferably used; and in particular, methoxycarbonyl group, vinyloxycarbonyl group are most preferably used.

The above-mentioned pairs of $R^{10}$ and $R^{11}$, $R^{12}$ and $R^{13}$ as well as $R^{10}$ or $R^{11}$ and $R^{12}$ or $R^{13}$ may be coupled to each other to form a ring. With respect to the ring coupled and formed in this manner, an alkylene group having carbon atoms of 1 to 20 or a phenylene group having carbon atoms of 6 to 30 is preferably used, and among these, alkylene groups having carbon atoms of 1 to 6 are more preferably used.

With respect to the metal represented by $R^7$, preferable examples thereof include zinc, nickel, copper, iron, cobalt, aluminum, magnesium, calcium, molybdenum, bismuth, manganese and cerium, and among these, zinc, nickel, aluminum, magnesium and calcium are more preferably used.

With respect to the quaternary ammonium represented by $R^7$, preferable examples thereof include ammonium, monomethyl ammonium, dimethyl ammonium, trimethyl ammonium, tetramethyl ammonium, tetraethyl ammonium and tetrabutyl ammonium, and among these, ammonium, tetramethyl ammonium and tetraethyl ammonium are more preferably used.

The content of the compound represented by the above-mentioned formulas (5) to (7) in the colorant-receiving layer is preferably set in the range of 0.01 $g/m^2$ to 5 $g/m^2$, more preferably, 0.05 $g/m^2$ to 3 $g/m^2$.

With respect to the compound having the above-mentioned aliphatic carbon-carbon double bond group, preferable examples include 2-buten-1,4-diol, sorbic acid, 4-hydroxy-styrene, L- ascorbic acid, styrene sulfinic acid, sodium styrene sulfinate and sodium sorbate, and among these, sodium styrene sulfonate and sodium sorbate are preferably used.

<Compounds Represented by Formula (8)>

In another embodiment of the inkjet recording sheet of the present invention, the recording sheet has a colorant-receiving layer on a support. The colorant-receiving layer includes at least one thioether-based compound represented by the following formula (8), which has an inorganic/organic ratio in the organic conceptual chart (I/O value) of at least 0.5.

$$X—(Y^1—S)_m—(Y^2—S)_n—Y^3—X \qquad \text{General Formula (8)}$$

In the formula (8), X represents a hydroxyl group, a carboxyl group, a carboxylate, an amino group, or a group including at least one of these groups. $Y^1$, $Y^2$ and $Y^3$ each independently represents an alkylene group. n represents an integer from 1 to 6, and m represents 0 or 1.

The alkylene groups represented by $Y^1$, $Y^2$ and $Y^3$ in the formula (8) preferably have from 1 to 12 carbon atoms, and more preferably from 1 to 6 carbon atoms.

Examples of the alkylene groups include a methylene group, an ethylene group, a propylene group, a tetramethylene group, a hexamethylene group and the like.

Examples of the hydroxyl group, carboxyl group, carboxylate, amino group or group including one or more thereof represented by X in the formula (8) include —$CH_2OH$, —$CH_2COOH$, —$CH_2NH_2$, —CHOH—$CH_2OH$, —$CHNH_2COOH$ and the like.

Specific examples of the thioether-based compound represented by the formula (8) to be included in the inkjet recording sheet of the present invention include, of the specific preferable examples of the compounds represented the formulas (1) to (4), 1–16, 1–17, 1–18, 1–21, 1–22, 1–27, 1–95, 1–96, 1–98 and the like.

The I/O value of the compound represented by the formula (8) is at least 0.5, and is preferably from 1.0 to 5.0.

The content of the compound represented by the above-mentioned formula (8) in the colorant-receiving layer is preferably set in the range of 0.01 $g/m^2$ to 5 $g/m^2$, more preferably, 0.05 $g/m^2$ to 3 $g/m^2$.

Further, in yet another embodiment of the inkjet recording sheet of the present invention, the recording sheet has a colorant-receiving layer on a support, and the colorant-receiving layer includes at least one thioether-based compound represented by the formula (8), which is water soluble. That is, the compound represented by the formula (8) preferably has a water soluble property.

In the inkjet recording sheet of the present invention, a compound represented by one of the formulas (1) to (4) preferably has either or both of an I/O value of at least 0.5 and a water soluble property. Moreover, a compound represented by one of the formulas (5) to (8) also preferably has either or both of an I/O value of at least 0.5 and the water soluble property.

Here, the water soluble property refers to a state that exhibits a solubility of not less than 1 weight % with respect to water at room temperature. Furthermore, when used in combination with, for example, an organic mordant of the present invention, these compounds may exhibit a water soluble property as salt formed together with the organic mordant. These compounds may be dissolved in an aqueous coating solution and applied so as to form a colorant-receiving layer; moreover, in order to further add the dissolving property, this may be used in a mixed manner with an organic solvent having a miscibility with water (for example, methanol, ethanol, acetone, tetrahydrofran, acetonitrile, dimethylformaldehyde, dioxane, etc.), if necessary. Alternatively, after the colorant-receiving layer has been formed, a coating solution containing the compound may be applied thereto in a separate manner.

<Organic Mordant>

The inkjet recording sheet of the present invention is made from a compound, which is one compound selected from the group consisting of compounds represented by the above-mentioned formulas (1) to (4) and which has either or both of an I/O value of at least 0.5 and a water soluble property, and contains at least one organic mordant selected from the group consisting of polyallylamine, polyvinylamine and derivatives of these.

Each of polyallylamine and polyvinylamine may be used as a homopolymer or a copolymer with another copolymer component, or one portion or the entire portion of polyallylamine unit and/or polyvinylamine unit may be formed into, for example, derivatives. With respect to the derivatives, for example, compounds represented by the following structural unit are listed.

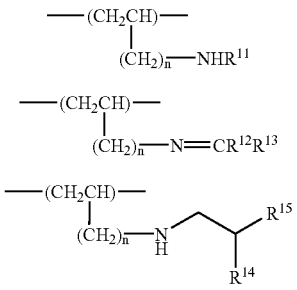

Structural Unit (1)

Structural Unit (2)

Structural Unit (3)

In the above-mentioned structural formula, each of $R^{11}$ to $R^{13}$ represents a hydrogen atom or an organic group that may have a substituent, $R^{14}$ represents an element atom or a methyl group and $R^{15}$ represents $COOR^{16}$, —1CN, or —$CON(R^{16},)R^{17}$. Each of $R^{16}$ and $R^{17}$ represents a hydrogen atom, an alkyl group (the alkyl group may have a branch or a cyclic structure, or may have an unsaturated bond or a substituent), an aryl group (which may have a substituent), or an aralkyl group (which may have a substituent). Here, n represents 0 or 1.

The above-mentioned organic group is a group having a hydrocarbon portion and/or a carbon halide portion, and besides these, this may contain atoms such as hydrogen, carbon, nitrogen, oxygen, sulfur, phosphor, silicon, boron and halogen, and/or a functional group composed of combinations of these. Examples of these include (substituent) alkyl group, (substituent) aralkyl group, (substituent) aryl group, (substituent) acyl group, (substituent) sulfonyl (group) and heterocyclic groups.

With respect to the above-mentioned organic groups represented by $R^{11}$ and $R^{13}$, specific examples include alkyl group (for example, methyl group, ethyl group, n-propyl group, i-propyl group, n-butyl group, i-butyl group, sec-butyl group, t-butyl group, n-hexyl group, cyclohexyl group, n-octyl group, 2-ethylhexyl group, n-decyl group, n-dodecyl group, octadecyl group, 1,3-butadienyl group, 1,3-pentadienyl group, etc.), aralkyl group (for example, benzyl group, phenylether group, vinylbenzyl group, 1-phenylvinyl group, 2-phenylvinyl group, etc.), aryl group (for example, phenyl group, naphthyl group, tolyl group, vinylphenyl group, etc.).

With respect to $R^{11}$ to $R^{13}$ having a substituent, specific examples include fluoroethyl group, trifluoroethyl group, methoxyethyl group, phenoxyethyl group, hydroxyphenylmethyl group, chlorophenyl group, dichlorophenyl group, trichlorophenyl group, bromophenyl group, iodophenyl group, fluorophenyl group, hydroxyphenyl group, methoxyphenyl group, hydroxyphenyl group, acetoxyphenyl group, cyanophenyl group, etc.).

With respect to those represented by $R^{11}$ to $R^{13}$ having an —OH group as a substituent, examples thereof are represented by the following formula.

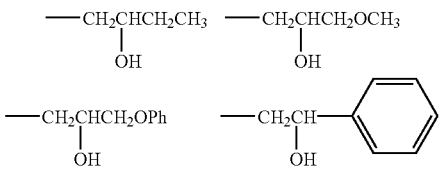

-continued

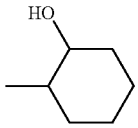

Moreover, with respect to $R^{11}$ to $R^{13}$, examples thereof include —$C(R^{21})R^{22}$—$COOR^{23}$(with respect to $R^{21}$ to $R^{23}$, for example, methyl group, ethyl group, butyl group, benzyl group, phenyl group, etc.), —CO—$R^{24}$—COOH (with respect to $R^{24}$, for example, —$CH_2CH_2$—, —$CH_2CH_2CH_2$—, —CH═CH—,

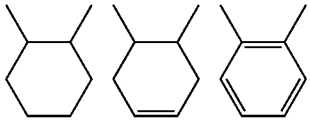

), —$COR^{25}$, —$COOR^{26}$, —$CONHR^{27}$, —$CSNHR^{28}$, —$S_2R^{29}$, —$P(=O)(OR^3)_2$ (with respect to $R^{25}$ to $R^{30}$, examples thereof include methyl group, ethyl group, propyl group, butyl group, octadecyl group, benzyl group, phenyl group, —CH═CH—Ph, etc.).

Moreover, in the above-mentioned structural unit (3), $R^{14}$ represents a hydrogen atom or a methyl group.

In the above-mentioned structural unit (3), $R^{15}$ represents $COOR^{16}$, CN, $CON(R^{16})$ $R^{17}$. Here, each of $R^{16}$ and $R^{17}$ represents a hydrogen atom, an alkyl group (the alkyl group may have a branch or ring structure, or may have an unsaturated bond or a substituent), an aryl group (which may have a substituent), or aralkyl group (which may have a substituent).

With respect to $R^{16}$ and $R^{17}$, specific examples include hydrogen, methyl group, ethyl group, n-propyl group, i-propyl group, n-butyl group, i-butyl group, sec-butyl group, t-butyl group, n-hexyl group, cyclohexyl group, n-octyl group, 2-ethylhexyl group, n-decyl group, n-dodecyl group, octadecyl group, allyl group, benzyl group, phenyl group, naphthyl group, biphenyl group, 1,1,1-triphloroethyl group and 2-hydroxy-3-chloropropyl group.

The structure of the derivative of polyallylamine or polyvinylamine is not particularly limited, and the resulting polymer preferably has a water soluble property, or is soluble to an organic solvent having miscibility to water, or this may also be used as latex particles having water dispersibility.

The derivatives of polyallylamine or the derivatives of polyvinylamine may be obtained through polymerization of the corresponding monomers; however, these may also be obtained through polymeric reactions of a polymer having repetitive units of polyallylamine and/or polyvinylamine. When, based upon the facts that the polymerizing property of monomers of allyl group is generally insufficient and that in the case of vinylamine, its precursor (for example, N-vinylformamide, N-vinylacetoamide, etc.) needs to be subjected to hydrolysis since no corresponding monomer is available after the polymerization, the manufacturing applicability and the degree of freedom in composing processes in the derivatives of polyallylamine and the derivatives of polyvinylamine, are taken into consideration, it is more preferable to utilize the latter method, that is, the polymerization reaction.

With respect to the polymerization reaction, a method has been proposed in which a polymer having a repetitive unit of polyallylamine and/or polyvinylamine is allowed to react with not less than any one compound selected from the group of compounds consisting of, for example, a halogen-containing compound, an epoxy-containing compound, a compound containing an acid anhydride, a compound containing an acid halide, an isocyanate-containing compound, a thioisocyanate-containing compound, a compound containing halo formate, an aldehyde-containing compound and compounds represented by $CH_2{=}C(R^4)R^{15}$.

Specific examples of such compounds include the following compounds:

With respect to the halogen-containing compound, examples thereof include iodomethane, bromoethane, bromobutane, bromooctane, chlorooctance, bromododecane, benzylbromide, benzylchloride, methoxybenzylchloride, propylchloroformate, butylchloroformate and phenylchloroformate. However, since the reaction of these compounds result in ammonium salt, a desalting process is preferably carried out thereon, or its modifying rate is preferably set to not more than 20 mol % of the amino group.

With respect to the epoxy-containing compound, examples thereof include butylene oxide, methylglycidylether, phenylglycidylether, allylglycidylether, cyclohexeneoxide, styrene oxide, etc.

With respect to the compound having an acid anhydride, examples thereof include acetic anhydride, succinic anhydride, maleic anhydride, glutaric anhydride, phthalic anhydride, cyclohexanedicarboxylic anhydride, cyclohexenedicarboxylic anhydride, etc.

With respect to the acid-halide-containing compound, examples thereof include acetic halide, (meth) acrylic acid halide, sorbic halide, benzoic halide, cinnamic halide, valeric halide, oleic halide, etc. However, since the reaction of these compounds result in ammonium salt, a desalting process is preferably carried out thereon, or its modifying rate is preferably set to not more than 20 mol % of the amino group.

With respect to the isocyanate-containing compound, examples thereof include butyl isocyanate, cyclohexyl isocyanate, phenyl isocyanate, etc.

With respect to the thioisocyanate-containing compound, examples thereof include butylthioisocyanate, cyclohexylthioisocyanate, phenylthioisocyanate, etc.

With respect to the halo formate compound, examples thereof include methylchloroformate, propylchloroformate, butylchloroformate and phenylchloroformate. However, since the reaction of these compounds result in ammonium salt, a desalting process is preferably carried out thereon, or its modifying rate is preferably set to not more than 20 mol % of the amino group.

With respect to the aldehyde-containing compound, examples thereof include acetaldehyde, butylaldehyde, benzaldehyde, salicylaldehyde, cinnamaldehyde, etc.

With respect to the compound by represented by $CH_2{=}C(R^{14})R^{15}$, examples thereof include acrylates (for example, methylacrylate, ethylacrylate, butylacrylate, hexylacrylate, 2-ethylhexylacrelate, cyclohexylacrylate, benzylacrylate, phenylacrylate, etc.), methacrylates (for example, methylmethacrylate, ethylmethacrylate, butylmethacrylate, hexylmethacrylate, 2-ethylhexylmethacrylate, cyclohexylmethacrylate, benzylmethacrylate, phenylmethacrylate, etc.), acrylonitrile, methacrylonitrile, acrylamides (for example, acrylamide, dimethylacrylamide, i-propylacrylamide, t-butylacrylamide, phenylacrylamide, etc.), methacrylamides (for example, methacrylamide, dimethylmethacrylamide, i-propylmethacrylamide, t-butylmethacrylamide, phenylmethacrylamide, etc.).

Moreover, not particularly limited, any compound may be used, as long as it is a compound that reacts with an amino group; and compounds other than the above-mentioned compounds, which include ketones such as methylethylketone and sulfonic acid halides such as benzene sulfonic acid halide, may be used.

With respect to polymers having a repetitive unit such as polyallylamine and/or polyvinylamine that are used as materials of the polymerization reactions, for example, polymers that are virtually composed of only the polyallylamine or polyvinylamine unit may be used. Since these polymers are easily obtained as polyallylamine and polyvinylamine, it is preferable to use these compounds as starting materials from the viewpoint of manufacturing applicability. Polyallylamine is obtained through a desalting process of a polymer of allylamine or salts thereof. Moreover, polyvinylamine is obtained by polymerizing a precursor of vinylamine (for example, N-vinylformamide, N-vinylacetoamide, etc.) as a monomer, and then subjecting the resulting product to hydrolysis, etc.

Moreover, besides the repetitive unit represented by the structural units (1) to (3), another copolymerizable monomer may be added within a range that would not impair the effects of the present invention, so as to form a copolymer.

With respect to the monomer unit that can form a copolymer in combination with these structural units, examples thereof include (meth)acrylic acid alkyl esters (for example, (meth)acrylic acid alkyl esters (with alkyl groups each having carbon atoms of 1 to 18), such as methyl(meth) acrylate, ethyl(meth)acrylate, propyl(meth)acrylate, isopropyl(meth)acrylate, n-butyl(meth)acrylate, isobutyl(meth) acrylate, t-butyl(meth)acrylate, hexyl(meth)acrylate, octyl (meth)acrylate, 2-ethylhexyl(meth)acrylate, lauryl(meth) acrylate and stearyl(meth)acrylate), (meth)acrylic acid cycloalkyl esters (such as cyclohexyl(meth)acrylate), (meth) acrylic acid aryl esters (such as phenyl(meth)acrylate), aralkyl esters (such as benzyl(meth)acrylate), substituted (meth)acrylic acid alkyl esters (such as 2-hydroxyethylethyl (meth)acrylate), (meth)acrylamides (such as (meth)acrylamide and dimethyl(meth)acrylamide), aromatic vinyls (such as styrene, vinyl toluene and α-methylstyrene), vinyl esters (such vinyl acetate, vinyl propionate), allyl esters (such as allyl acetate), halogen-containing monomers (such as vinylidene chloride, vinyl chloride), and nonionic monomers such as vinyl cyanide (such as (meth)acrylonitrile) and olefins (such as ethylene and propylene).

Moreover, in particular, a polymer having a structural unit represented by n=0 is normally obtained not by polymerizing vinyl amine, but by subjecting a polymer such as N-vinyl formaldehyde and N-vinyl acetamide to hydrolysis; therefore, these monomer units are allowed to remain.

Furthermore, monomers having a basic unit may be used. Examples thereof include dialkylaminoethyl(meth)acrylate, dialkylamino propyl(meth)acrylate, dialkylaminoethyl (meth)acryl amide, dialkylamino propyl(meth)acryl amide (with respect to dialkyl groups shown here, examples thereof include dimethyl, diethyl, dibutyl, methylbenzyl, etc.).

One kind of these copolymerizable components may be used, or two or more kinds of these may be used in combination.

Moreover, when a copolymer is used, the total content of polyallyl amine, polyvinyl amine and repetitive units represented by the structural units (1) to (3) is preferably set to not less than 50 mol %, more preferably, 80 mol %. By setting the total content to not less than 50 mol %, it becomes possible to provide sufficient adherence to the ink (dye), and consequently to provide sufficient resolution, effects for preventing age-based bleeding, light resisting property and ozone resisting property.

This polymerization reaction can be carried out by using a known method, and in general, a polymer having repetitive units of polyallylamine and polyvinylamine and a reagent to be polymerized therewith are mixed in a solvent, and allowed to react with each other by using a catalyst, etc. in combination, if necessary. The solvent is not particularly limited as long as it would not interfere with the reaction to a great degree; and for example, water, methanol, ethanol, acetone, acetonitrile, tetrahydrofran, dimethylsulfoxide, dimethylformamide and dimethylacetamide, and a mixed solvent of these, may be used. Among these, water or a mixed solvent of water and an organic solvent having miscibility with water is preferably used from the viewpoint of manufacturing applicability. Here, in the case when a compound, such as isocyanate and acid halide, having reactivity to water and alcohols is applied, a solvent that is non-active to these (such as acetone, acetonitrile, tetrahydrofran, dimethylsulfoxide, dimethylformamide and dimethylacetamide) is preferably used.

The organic mordant of the present invention is preferably set in the range of 1000 to 500000, more preferably, 2000 to 400000, in the mass average molecular weight. The molecular weight exceeding 1000 makes it possible to obtain a sufficient water resisting property, and the molecular weight of less than 500000 makes it possible to suppress an excessive increase in the viscosity to provide sufficient workability.

Moreover, with respect to a preferable total content of the organic mordant in the inkjet recording sheet of the present invention, it is set in the range of 0.1 to 5 $g/m^2$, more preferably, 0.2 to 3 $g/m^2$. The total content of not less than 0.1 $g/m^2$ makes it possible to sufficiently reduce age-based bleeding, and consequently to provide a sufficient ozone resisting property. Moreover, the total content of less than 5 $g/m^2$ makes it possible to prevent degradation in the ink absorbing property sufficiently.

Furthermore, besides the above-mentioned organic mordant, a non-polymer mordant such as aluminum sulfate, aluminum chloride, aluminum polychloride and magnesium chloride may be used in combination within a range that would not impair the effects of the inkjet recording sheet of the present invention.

Here, another known mordant may be used combinedly within the range that would not impair the performances of the inkjet recording sheet of the present invention.

Examples of the known mordant are listed as follows:

With respect to organic mordants used as the above-mentioned polymer mordant, specific examples include those disclosed in JP-A Nos. 48-28325, 54-74430, 54-124726, 55-22766, 55-142339, 60-23850, 60-23851, 60-23852, 60-23853, 60-57836, 60-60643, 60-118834, 60-122940, 60-122941, 60-122942, 60-235134 and 1-161236, U.S. Pat. Nos. 2,484,430, 2,548,564, 3,148,061, 3,309,690, 4,115,124, 4,124,386, 4,193,800, 4,273,853, 4,282,305 and 4,450,224, JP-A Nos. 1-161236, 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091, 8-2093, 8-174992, 11-192777 and 2001-301314, JP-B Nos. 5-35162, 5-35163, 5-35164, 5-88846, JP-A Nos. 7-118333, and 2000-344990, and Japanese Patent Nos. 2648847, 2661677.

With respect to inorganic mordants, polyvalent water-soluble metal salts and hydrophobic metal salt compounds are listed.

Specific examples of the inorganic mordants include salts or complexes of metal selected from the group consisting of magnesium, aluminum, calcium, scandium, titanium, vanadium, manganese, iron, nickel, copper, zinc, gallium, germanium, strontium, yttrium, zirconium, molybdenum, indium, barium, lanthanum, cerium, praseodymium, neodymium, samarium, europium, gadolinium, dysprosium, erbium, ytterbium, hafnium, tungsten, bismuth.

Among these, specific preferable examples include calcium acetate, calcium chloride, calcium formate, calcium sulfate, barium acetate, barium acetate, barium sulfate, barium phosphate, barium sulfate, barium phosphate, manganese chloride, manganese acetate, manganese formate dihydrate, manganese sulfate ammonium hexahydrate, cupric chloride, ammonium chloride cupper (II) dihydrate, cupper sulfate, cobalt chloride, cobalt thiocyanate, cobalt sulfate, nickel sulfate hexahydrate, nickel chloride hexahydrate, nickel acetate tetrahydrate, nickel sulfate ammonium hexahydrate, nickel sulfate amide tetrahydrate, aluminum sulfate, alum aluminum, basic polyaluminum hydroxide, aluminum sulfite, thioaluminum sulfate, aluminum polychloride, aluminum nitrate nonahydrate, aluminum chloride hexahydrate, ferrous bromide, ferrous chloride, ferric chloride, ferrous sulfate, ferric sulfate, zinc phenol sulfonate, zinc bromide, zinc chloride, zinc nitrate hexahydrate, zinc sulfate, titanium tetrachloride, tetraisopropyl titanate, titanium acetylacetate, titanium lactate, zirconium acetylacetate, zirconyl acetate, zirconyl sulfate, zirconium ammonium carbonate, zirconyl stearate, zirconyl octylate, zirconyl nitrate, zirconium oxychloride, zirconium hydroxychloride, chromium acetate, chromium sulfate, magnesium sulfate, magnesium chloride hexahydrate, magnesium citrate nonahydrate, sodium phosphate tungstate, sodium tungsten citrate, 12 tungstophosphate n-hydrate, 12 tungstosilicate 26 hydrate, molybdenum chloride, 12 molybdophosphate n-hydrate, gallium nitrate, germanium nitrate, strontium nitrate, yttrium acetate, yttrium chloride, yttrium nitrate, indium nitrate, lanthanum nitrate, lanthanum chloride, lanthanum acetate, lanthanum benzoate, cerium chloride, cerium sulfate, cerium octylate, praseodymium nitrate, neodymium nitrate, samarium nitrate, europium nitrate, gadolinium nitrate, dysprosium nitrate, erbium nitrate, ytterbium nitrate, hafnium chloride and bismuth nitrate.

The above-mentioned mordant is used in a method in which it is added to a coating solution (first coating solution) containing fine particles and a water soluble resin, or in a method in which it is contained in a second coating solution and applied when it might cause aggregation with fine particles.

<Acidic Compound>

In the inkjet recording sheet of the present invention, from the viewpoint of prevention of age-based coloring, the colorant-receiving layer contains (A) at least one compound selected from the group consisting of compounds represented by the above-mentioned formulas (1) to (4), which has either or both of an I/O value of at least 0.5 and water soluble property, and (B) at least one organic mordant selected from the group consisting of polyallylamine, polyvinylamine and derivatives of these; and this is preferably allowed to further contain at least one acidic compound selected from the group consisting of a halogenated hydroacid compound, a sulfuric acid compound, a nitric acid compound, a phosphoric acid compound, a sulfonic acid compound, a carboxylic acid compound and a boric acid compound.

The number of valence of the above-mentioned acid is not particularly limited, polyvalent acids and polymer acids may be used. Moreover, the content of this acidic compound is different depending on the kind of acid, and the amount of addition is preferably adjusted, and used so as to provide a proper pH value on the surface. The surface pH is preferably set to 3 to 8, more preferably, 5 to 7.5. Thus, it becomes possible to improve an after-yellowing preventive property on the white base portion.

The measurement of the surface pH is carried out in conformity with A method (coating method) in the surface pH measurements standardized by the Japan Technical Association of Paper Pulp Industry (J. TAPPI). For example, the above-mentioned measurements can be carried out by using the paper surface pH measuring set, "Format MPC", corresponding to the above-mentioned A method, made by Kyoritsu Institute of Physical and Chemical Research (K.K.).

Moreover, these acidic compounds may exist in the form of salts. In this case, with respect to the cation, inorganic ions such as alkali metal ions or organic ions may be used; and organic ions are more preferably used.

With respect to organic substances that form the above-mentioned salts, in addition to low molecular compounds such as ammonium salts, polymers, etc. having primary to tertiary amino groups, such as polyethylene imine, polydiallyl amine and polyallyl amine, may be used.

With respect to the above-mentioned halogenated hydroacid compound, examples thereof include hydrofluoric acid, hydrochloric acid, hydrobromic acid, hydroiodic acid, or salts of these (for example, ammonium chloride, etc.).

With respect to sulfuric acid compounds, examples thereof include sulfuric acid, sodium sulfate, ammonium sulfate, calcium sulfate, etc.

With respect to nitric acid compounds, examples thereof include nitric acid, sodium nitrate, ammonium nitrate, calcium nitrate, etc.

With respect to phosphoric acid compounds, examples thereof include phosphoric acid, ammonium phosphate, magnesium phosphate, polyphosphate, etc.

With respect to sulfonic acid compounds, methane sulfate, propane sulfate, benzene sulfate, toluene sulfate, trifluoromethane sulfate, styrene sulfate, naphthalene sulfate, naphthalene disulfate and hydroxybenzene sulfate, or salts of these.

With respect to carboxylic acid compounds, examples thereof include formic acid, acetic acid, glycolic acid, oxalic acid, propionic acid, malonic acid, succinic acid, adipic acid, maleic acid, itaconic acid, malic acid, tartaric acid, citric acid, benzoic acid, phthalic acid, isophthalic acid, glutaric acid, gluconic acid, lactic acid, asparagine acid, glutamic acid, salicylic acid, trifluoroacetic acid, acrylic acid, methacrylic acid, cinnamic acid, 4-hydroxybenzoic acid, aminobenzoic acid, α-resorcinic acid, β-resorcinic acid, γ-resorcinic acid, gallic acid, fluoroglycine, sulfosalicylic acid and ascorbic acid, or salts of these.

With respect to boric acid compounds, for example, boric acid, ammonium borate, sodium borate, etc.

The above-mentioned acidic compound may be added to a coating solution (which may be provided as the same solution or different solutions) that contains (A) at least one compound selected from the group consisting of compounds represented by the above-mentioned formulas (1) to (4) and which has either or both of an I/O value of at least 0.5 and water soluble property, and (B) at least one organic mordant selected from the group consisting of polyallylamine, polyvinylamine and derivatives of these, in a separate manner, or the acidic compound may be mixed with (A) at least one compound selected from the group consisting of compounds represented by the above-mentioned formulas (1) to (4) and which has either or both of an I/O value of at least 0.5 and water soluble property, and (B) at least one organic mordant selected from the group consisting of polyallylamine, polyvinylamine and derivatives of these, and then added to the coating solution, that is, may be used in the form of a salt. Moreover, the respective compounds may be prepared in respectively different solutions, and these may be applied as respectively different coating solutions.

In the present invention, from the viewpoint of prevention of bleeding, the above-mentioned acidic compound is particularly prepared as an organic acid.

The organic acid refers to an organic compound having acidic properties, and examples thereof include carboxylic acid and sulfonic acid. More specifically, examples of the sulfonic acid include methane sulfonic acid, propane sulfonic acid, benzene sulfonic acid, p-toluene sulfonic acid, styrene sulfonic acid and naphthalene sulfonic acid, or salts of these.

With respect to the above-mentioned carboxylic acid compound, examples thereof include acetic acid, propionic acid, citric acid, malic acid, lactic acid, (meth)acrylic acid, benzoic acid and cinnamic acid, or salts of these.

Moreover, the total content of the acidic compound in the inkjet recording sheet is preferably set in the range of 0.05 to 5 $g/m^2$, more preferably, 0.1 to 2 $g/m^2$. The total content of not less than 0.05 $g/m^2$ makes it possible to suppress the generation of age-based coloring, and the total content of less than 5 $g/m^2$ makes it possible to reduce age-based bleeding, and consequently to prevent degradation in the ink absorbing property.

<Water Soluble Resin>

In the inkjet recording sheet of the present invention, the colorant-receiving layer contains (A) at least one compound selected from the group consisting of compounds represented by the above-mentioned formulas (1) to (4) and which has either or both of an I/O value of at least 0.5 and water soluble property, and (B) at least one organic mordant selected from the group consisting of polyallylamine, polyvinylamine and derivatives of these; and this is preferably allowed to further contain a water soluble resin.

The above-mentioned water soluble resin is preferably allowed to contain at least one member selected from the group consisting of polyvinyl alcohol-based resins, cellulose-based resins, resins having an ether bond, resins having a carbamoyl group, resins having a carboxyl group and gelatins.

With respect to the above-mentioned water soluble resin, examples thereof include: polyvinyl alcohol-based resins that are resins having a hydroxy group as a hydrophilic structural unit [such as polyvinyl alcohol (PVA), acetacetyl modified polyvinyl alcohol, cation modified polyvinyl alcohol, anion modified polyvinyl alcohol, silanol modified polyvinyl alcohol, polyvinyl acetal, etc.], cellulose-based resins [such as methylcellulose (MC), ethylcellulose (EC), hydroxyethylcellulose (HEC), carboxymethylcellulose (CMC), hydroxypropylcellulose (HPC), hydroxyethylmethylcellulose, hydroxypropylmethylcellulose, etc.], resins having chitins, chitosans, starch or resins having an ether bond [such as polyethylene oxide (PEO), polypropylene oxide (PPO), polyethylene glycol (PEG), polyvinylether (PVE), etc.], resins having a carbamoyl group [such as polyacryl amide (PAAM), polyvinylpyrrolidone (PVP), hydrazine polyacrylate, etc.], and these are preferably used.

In Moreover, polyacrylate, maleic acid resins, alginate, gelatins, etc., which have a carboxyl group as a dissociated group, may also be listed.

Among these, in particular, polyvinyl alcohol-based resins are preferably used. Examples of the polyvinyl alcohols have been disclosed in JP-B Nos. 4-52786, 5-67432, 7-29479, Japanese Patent No. 2537827, JP-B No. 7-57553, Japanese Patent Nos. 2502998, 3053231, JP-A No. 63-176173, Japanese Patent No. 2604367, JP-A Nos. 7-276787, 9-207425, 11-58941, 2000-135858, 2001-205924, 2001-287444, 62-278080, 9-39373, Japanese Patent No. 2750433 and JP-A Nos. 2000-158801, 2001-213045, 2001-328345, 8-324105, 11-348417.

Moreover, with respect to water soluble resins other than the polyvinyl alcohol-based resins, examples thereof have been listed as compounds in paragraphs [0011] to [0014] in Japanese Patent Application Laid-Open (JP-A) No. 11-165461.

These water soluble resins may be respectively used alone, or two or more of these may be used in combination.

In the present invention, the content of the water soluble resin is preferably set in the range of 9 to 40 weight % with respect to the total mass of the entire solid components in the colorant-receiving layer, more preferably, in the range of 12 to 33 mass %.

<Fine Particles>

In the inkjet recording sheet of the present invention, the colorant-receiving layer contains (A) at least one compound selected from the group consisting of compounds represented by the above-mentioned formulas (1) to (4) and which has either or both of an I/O value of at least 0.5 and water soluble property, and (B) at least one organic mordant selected from the group consisting of polyallylamine, polyvinylamine and derivatives of these; and this is preferably allowed to further contain the above-mentioned water soluble resin, and fine particles.

With respect to the above-mentioned fine particles, it is preferable to contain at least one member selected from the group consisting of silica fine particles, colloidal silica, alumina fine particles and pseudo-boehmite.

Thus, the colorant-receiving layer is allowed to contain fine particles so that a porous structure is obtained, thereby making it possible to improve the ink absorbing function. In particular, when the content of solid components of the fine particles in the colorant-receiving layer is set to not less than 50 mass %, more preferably, 60 mass %, it becomes possible to form a better porous structure, and consequently to provide an inkjet recording sheet having a sufficient ink-absorbing property. Here, the content of solid components of fine particles in the colorant-receiving layer refers to a content calculated based upon components other than water of the compositions constituting the colorant-receiving layer.

With respect to the fine particles of the present invention, either of organic fine particles or inorganic fine particles may be used; however, from the viewpoint of ink-absorbing property and image-stability, it is preferable to use inorganic fine particles.

With respect to the above-mentioned organic fine particles, for example, polymer fine particles, obtained through processes, such as emulsion polymerization, micro-emulsion polymerization, soap-free polymerization, seed polymerization, dispersion polymerization, and suspension polymerization, are preferably used, and specific examples include powder, latex or polymer fine particles in an emulsion state of polyethylene, polypropylene, polystyrene, polyacrylate, polyamide, silicon resins, phenol resins, natural polymers, etc.

With respect to the above-mentioned inorganic fine particles, examples thereof include silica fine particles, colloidal silica, titanium dioxide, barium sulfate, calcium silicate, zeolite, kaolinite, halloysite, mica, talc, calcium carbonate, magnesium carbonate, calcium sulfate, pseudo-boehmite, zinc oxide, zinc hydroxide, alumina, aluminum silicate, calcium silicate, magnesium silicate, zirconium oxide, zirconium hydroxide, cerium oxide, lanthanum oxide and yttrium oxide. Among these, from the viewpoint of formation of a preferable porous structure, silica fine particles, colloidal silica, alumina fine particles or pseudo-boehmite are preferably used. The fine particles may be used as primary particles as they are, or may be used after having been formed into secondary particles. The average primary particle size of these fine particles is preferably set to not more than 2 μm, more preferably, not more than 200 nm.

Moreover, silica fine particles having the average primary particle size of not more than 20 nm, colloidal silica of the average primary particle size not more than 20 nm, or pseudo-boehmite having the average fine-pore radius of 2 to 15 nm, may be used more preferably, and in particular, silica fine particles, alumina fine particles and pseudo-boehmite are most preferably used.

In general, the above-mentioned silica fine particles are mainly classified into wet-method particles and dry-method (gaseous-phase method) particles based upon the manufacturing methods thereof. In the wet method, the active silica is generated through acid decomposition of the silicate, and this is properly polymerized, and aggregated and precipitated to obtain moisture-containing silica; and this method has been mainly used.

Here, in the gaseous phase method, a method (flame hydrolysis method) in which silica halide is subjected to hydrolysis in a gaseous phase under a high temperature, and another method (arc method) in which silica sand and corks are heated and reduced to evaporate in an electric furnace, and the resulting gas is oxidized by air, are mainly adopted to provide anhydrous silica, and "silica of gaseous-phase method" refers to anhydrous silica fine particles obtained through the gaseous method. With respect to the silica fine particles used in the present invention, in particular, silica fine particles of gaseous-phase method are preferably used.

The above-mentioned silica of the gaseous-phase method is different from moisture-containing silica in the density of silanol groups on the fine particle surface and the presence or absence of voids, and exhibits different properties; however, this is suitable for forming a three-dimensional structure with a higher porosity. The reason for this has not been clarified, but in the case of moisture-containing silica, the density of silanol groups is 5 to 8/nm$^2$ on the fine particle surface, and the greater density allows the silica fine particles to aggregate densely; in contrast, in the case of the silica of the gaseous phase, the density of silanol groups is 2 to 3/nm$^2$ on the fine particle surface, and the smaller density forms a sparse aggregation (flocculate), resulting in a structure having a higher porosity.

Since the above-mentioned silica of gaseous-phase method has a greater specific surface area, it has high efficiency in ink absorbing and holding properties, and since it has a lower refractive index, the receiving layer is allowed to have transparency when the dispersion is carried out to an appropriate particle size, and it is possible to obtain high color density and a superior color developing property. The high transparency of the receiving layer is important not only for the application requiring high transparency such as OHP, but also for the application to recording sheets such as paper having photographic gloss so as to provide a high color density with superior color-developing gloss.

With respect to the average primary particle size of the above-mentioned silica of gaseous-phase method, it is preferably set to not more than 30 nm, more preferably, not more than 20 nm, most preferably, not more than 10 nm, by far the most preferably, in the range of 3 to 10 nm. In the silica of gaseous-phase method, since the particles tend to adhere to each other by hydrogen bond due to silanol groups, it is possible to form a structure having a great porosity in the case when the average primary particle size is set to not more than 30 nm, and consequently to effectively improve the ink-absorbing property.

Moreover, the silica fine particles may be used in combination with the above-mentioned other fine particles. In the case when the silica of gaseous-phase method is used in combination with the other fine particles, the content of the silica of gaseous-phase method in the entire fine particles is preferably set to not less than 30 mass %, more preferably, 50 mass %.

In the present invention, with respect to the inorganic fine particles, alumina fine particles, alumina anhydrates and the mixture or composite of these are preferably used. Among these, alumina anhydrates are preferable because of their good absorbing and fixing properties of ink; in particular, pseudo-boehmite ($Al_2O_3$—$nH_2O$) is more preferably used. With respect to the alumina hydrates, various types of these may be used, and it is preferable to use boehmite in a sol state as the material since a smooth layer is easily obtained.

With respect to the fine-pore structure of the pseudo-boehmite, the average fine-pore radius is preferably set in the range of 1 to 30 nm, more preferably, 2 to 15 nm. Moreover, the capacity of the fine pore is preferably set in the range of 0.3 to 2.0 cc/g (ml/g), more preferably, 0.5 to 1.5 cc/g (ml/g). Here, the above-mentioned measurements of the fine-pore radius and fine-pore capacity are carried out by using a nitrogen absorbing-releasing method; and for example, a gas absorbing-releasing analyzer (for example, "Omunisorp 369" trade name of Coulter Co., Ltd.) is used.

Moreover, among the alumina fine particles, the alumina fine particles of gaseous-phase method, which has a greater specific surface area, are preferably used. The average primary particle size of the alumina fine particles of gaseous-phase method is preferably set to not more than 30 nm, more preferably, not more than 20 nm.

In the case when the above-mentioned fine particles are used in inkjet recording sheets, for example, those modes disclosed in the following gazettes may be preferably used: JP-A Nos. 10-81064, 10-119423, 10-157277, 10-217601, 11-348409,2001-138621, 2000-43401,2000-211235, 2000-309157, 2001-96897, 2001-138627, 11-91242, 8-2087, 8-2090, 8-2091, 8-2093, 8-174992, 11-192777, and 2001-301314.

In the inkjet recording sheet of the present invention, the aforementioned water soluble resin and the above-mentioned fine particles, which constitute the colorant-receiving layer, may be respectively formed by a single material or a mixed system of a plurality of materials.

Here, from the viewpoint of transparency, it is important to select the kind of the water soluble resin to be combined with the fine particles, that is, in particular, the silica fine particles. In the case of the application of the silica of gaseous-phase method, polyvinyl alcohol-based resins are preferably used as the water soluble resin, and among these, polyvinyl alcohol-based resins having a degree of saponification of 70 to 100% are more preferably used, and polyvinyl alcohol-based resins having a degree of saponification of 80 to 99.5% are most preferably used.

The above-mentioned polyvinyl alcohol-based resin has a hydroxide group as its structural unit, and since this hydroxide group and the surface silanol group of the silica fine particles form a hydrogen bond, it is possible to easily form a three-dimensional mesh structure using the secondary particle of the silica fine particles as a mesh chain unit. The formation of the three-dimensional mesh structure is considered to form a colorant-receiving layer that has a porous structure with a high porosity and sufficient strength.

In the inkjet recording process, the porous colorant-receiving layer obtained as described above makes it possible to absorb ink rapidly through capillarity, and consequently to form preferable dots having a true round shape, without causing ink bleeding.

Moreover, the polyvinyl alcohol-based resin may be used in combination with the other water soluble resins. When the above-mentioned polyvinyl alcohol-based resin is used in combination with the other water soluble resin, the content of the polyvinyl alcohol-based resin in the entire water soluble resin is preferably set not less than 50 mass %, more preferably, not less than 70 mass %.

Ratio of Contents Between Fine Particles and Water Soluble Resin

The ratio of mass contents [PB ratio (x/y)] between the fine particles (x) and the water soluble resin (y) gives great influences to both of the film structure and the film strength of the colorant-receiving layer. In other words, when the ratio of mass contents [PB ratio] increases, the porosity, fine pore capacity and surface area (per unit mass) become greater; however, the density and strength tend to decrease.

In the colorant-receiving layer of the present invention, the above-mentioned mass content ratio [PB ratio (x/y)] is preferably set in the range of 1.5:1 to 10:1 in order to prevent degradation in the film strength and cracks at the time of the drying process due to a great PB ratio, and also to prevent clogging of the voids with the resin due to a small PB ratio and the subsequent reduction in the porosity and degradation in the ink-absorbing property.

When a recording sheet is passing through the transporting system in an inkjet printer, it tends to be subjected to a stress; therefore, it is necessary for the colorant-receiving layer to have a sufficient film strength. Moreover, in order to prevent cracking and separation of the colorant-receiving layer when it is cut into a sheet shape, it is necessary for the colorant-receiving layer to have a sufficient film strength. Taking these points into consideration, the above-mentioned mass content ratio (x/y) is more preferably set to not more than 5:1; and from the viewpoint of high-speed ink-absorbing property in the inkjet printer, it is more preferably set to not more than 2:1.

For example, when a coating solution in which silica fine particles of gaseous-phase method having the average primary particle size of not more than 20 nm are completely dissolved in a water solution at a mass ratio of (x/y) 2:1 to 5:1 is prepared and applied to a support, and when the resulting coated layer is dried, a three-dimensional mesh structure having secondary particles of the silica fine particles as mesh chains is formed so that it becomes possible to easily form a porous film having a light-transmitting property, with the average fine-pore diameter being set to not more than 30 nm, the porosity being set to 50 to 80%, the fine-pore specific capacity being set to not less than 0.5 ml/g and the specific surface area being set to not less than $10m^2/g$.

<Cross-linking Agent>

In the colorant-receiving layer in the inkjet recording sheet of the present invention, preferably, its coat layer containing the fine particles and the water soluble resin further contains a cross-linking agent that can cross-links the water soluble resin so that a porous layer is cured and formed through the cross-linking reaction between the cross-linking agent and the water soluble resin.

A boron compound is preferably used for the cross-linking process of the above-mentioned water soluble resin, that is, in particular, polyvinyl alcohol. With respect to the boron compound, examples thereof include borax, boric acid and borate (for example, ortho-borate, $InBO_3$, $ScBO_3$, $YBO_3$, $LaBO_3$, $Mg_3(BO_3)_2$, $CO_3(BO_3)_2$, di-borate (for example, $Mg_2B_2O_5$), $Co_2B_2O_5$), methaborate (for example, $LiB_2$, $Ca(BO_2)_2$, $NaBO_2$, $KBO_2$), tetra-borate (for example, $Na_2B_4O_7$—$10H_2O$), penta-borate (for example, $KB_5O_8$—$4H_2O$, $Ca_2B_6O_{11}$—$7H_2O$, $CsB_5O_5$). Among these, borax, boric acid and borate are preferably used, and in particular, boric acid is more preferably used, because of the capability of smooth cross-linking reaction.

With respect to the cross-linking agent for the above-mentioned water soluble resin, besides boron compounds, the following compounds may be used:

For example, aldehyde compounds such as formaldehyde, glyoxal and glutaraldehyde; ketone compounds such as diacetyl and cyclopentadion; active halogen compounds such as bis(2-chloroethylurea)-2-hydroxy-4,6-dichloro-1,3,5-triazine and 2,4-dichloro-6-S-triazine-sodium salt; active vinyl compounds such as divinylsulfonic acid, 1,3-vinylsulfonyl-2-propanol, N,N'-ethylene bis(vinylsulfonylacetamide), and 1,3,5-triacryloyl-hexahydro-S-triazine; N-methylol compounds such as dimethylolurea and methyloldimethylhydantoin; melamine resins (such as methylolmelamine and alkylated methylolmelamine); epoxy resins;

isocyanate compounds such as 1,6-hexamethylene diisocyanate; aziridine compounds disclosed in the specifications of U.S. Pat. Nos. 3,017,280 and 2,983,611; carboxyimide compounds disclosed in the specification of U.S. Pat. No. 3,100,704; epoxy compounds such as glyceloltriglycidyl ether; ethylene imino compounds such as 1,6-hexamethylene-N,N'-bisethyleneurea; halogenated carboxyaldehyde compounds such as mucochloric acid and mucophenoxychloric acid; dioxane compounds such as 2,3-dihydroxydioxane; metal-containing compounds such as titanium lactate, aluminum sulfate, chrome alum, potassium alum, zirconyl acetate and chromium acetate; polyamine compounds such as tetraethylenepentamine; hydrazide compounds such as adipic acid hydrazide, and low molecular compounds or polymers containing not less than two oxazoline groups.

One kind of the above-mentioned cross-linking agents may be used alone, or two or more kinds of these may be used in combination.

For example, in the case of a boron compound, the addition of the cross-linking agent is preferably carried out in the following manner. In other words, the colorant-receiving layer is a layer formed by cross-linking and curing a coated layer on which a coating solution containing a water soluble resin containing fine particles and polyvinyl alcohol and the boron compound (hereinafter, referred to as a first coating solution) has been coated, and the above-mentioned cross-linking and curing process is carried out by applying a basic solution having a pH value of not less than 8 to the above-mentioned coated layer or the coat film, (1) simultaneously with the coating process of the above-mentioned coating solution or (2) during a drying process of the coat layer formed by applying the coating solution before the coated layer comes to have decreasing rate of drying.

Here, the amount of use of the cross-linking agent is preferably set to 1 to 50 mass %, more preferably, 5 to 40 mass %.

<Other Components>

The inkjet recording sheet of the present invention may further contain various known additives, if necessary; and examples thereof include an ultraviolet-ray absorbing agent, an oxidation inhibitor, a fluorescent bleaching agent, monomers, a polymerization initiator, a polymerization inhibitor, a bleeding inhibitor, an antiseptic agent, a viscosity stabilizer, an antifoamer, a surfactant, an antistatic agent, a matting agent, a curl inhibitor and a water resisting agent.

In the present invention, preferably, the colorant-receiving layer further contains known quality-keeping agents such as an ultraviolet-ray absorbing agent, an oxidation inhibitor and a bleeding inhibitor.

With respect to these ultraviolet-ray absorbing agent, oxidation inhibitor and bleeding inhibitor, examples thereof include: alkylated phenol compounds (including hindered phenol compounds), hydroquinone compounds, alkylated hydroquinone compounds, tocopherol compounds, bisphenol compounds, O-, N- and S-benzyl compounds, hydroxybenzyl compounds, triazine compounds, phosphonate compounds, acylaminophenol compounds, ester compounds, amide compounds, ascorbic acid, amine-based antioxidants, 2-(2-hydroxyphenyl)benztriazol compound, 2-hydroxy benzphenon compound, acrylate, water soluble or hydrophobic metal salts, organic metal compounds, metal complexes, hindered amine compounds (including TEMPO compounds), 2-(2-hydroxyphenyl)l, 3, 5, -triazine compound, metal inactivating agent, phosphit compounds, phosphonite compounds, hydroxy amine compounds, nitron compounds, peroxide scavenger, polyamide stabilizers, polyether compounds, basic assisting stabilizers, nucleus agents, benzofuranone compounds, indolinone compounds, phosphine compounds, polyamine compounds, hydrazide compounds, amidine compounds, starch compounds, hydroxybenzoic acid compounds, dihydroxybenzoic acid compounds and trihydroxybenzoic acid compounds.

Among these, alkylated phenol compounds, bisphenol compounds, ascorbic acid, amine-based antioxidant inhibitors, water soluble or hydrophobic metal salts, organic metal compounds, metal complexes, hindered amine compounds, hydroxy amine compounds, polyamine compounds, hydrazide compounds, hydroxybenzoic acid compounds, dihydroxybenzoic acid compounds and trihydroxybenzoic acid compounds are more preferably used.

Specific examples of the compounds are listed in the specifications of the following gazettes: Japanese Patent Application No. 2002-13005, JP-A Nos. 10-182621, 2001-260519, JP-B Nos. 4-34953 and 4-34513, Japanese Patent Application Laid-Open (JP-A) No. 11-170686, Japanese Examined Patent Publication 4-34512, EP Patent Publication No. 1138509, JP-A Nos. 60-67190, 7-276808, 2001-94829, 47-10537, 58-111942, 58-212844, 59-19945, 59-46646, 59-109055, 63-53544, JP-B Nos. 36-10466, 42-26187, 48-30492, 48-31255, 48-41572, 48-54965 and 50-10726; US. Pat. Nos. 2,719,086, 3,707,375, 3,754,919, 4,220,711.

Specific examples of the compounds are also listed in the specifications of the following gazettes: JP-B Nos. 45-4699, 54-5324, European Patent Application Nos. 223739, 309401, 309402, 310551, 310552 and 459416; German Patent Application No. 3435443; JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 63-88381, 63-113536, 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437, 5-170361, JP-B Nos. 48-43295 and 48-33212; and U.S. Pat. Nos. 4,814,262 and 4,980,275.

With respect to the above-mentioned other components, one kind of them may be used alone, or two or more kinds of these may be used in combination. The above-mentioned other components may be formed into a water soluble state, a dispersed state, a polymer-dispersed state, an emulsion state or an oil-droplet state, and then applied, or may be contained into microcapsules. In the inkjet recording sheet of the present invention, the amount of addition of the above-mentioned other components is preferably set in the range of 0.01 to 10 g/m$^2$.

Moreover, in order to improve the dispersing property of inorganic fine particles, the surface of the inorganic file particles may be treated by a silane coupling agent. With respect to the silane coupling agent, it is preferable to use such an agent that includes, in addition to the potion for carrying out the coupling process, organic functional groups (for example, vinyl group, amino group (the primary to tertiary amino groups, the quaternary ammonium salt), epoxy group, mercapto group, chloro group, alkyl group, phenyl group, ester group, etc.).

In the present invention, the coating solution for the colorant-receiving layer is preferably allowed to contain a surfactant. With respect to the surfactant, any of cationic, anionic, nonionic, amphoteric, fluorine-based and silicon-based surfactants may be used.

With respect to the above-mentioned nonionic surfactant, examples thereof include polyoxyalkylenealkyl ethers and polyoxyalkylenealkyl phenyl ethers (for example, diethyleneglycolmonoethyl ether, diethyleneglycoldiethyl ether, polyoxyethylenelauryl ether, polyoxyethylenestearyl ether, polyoxyethylenenonylphenyl ether, etc.), oxyethylene-oxypropylene block copolymer, sorbitan fatty acid esters (for example, sorbitan monolaurate, sorbitan monoolate, sorbitan triolate, etc.), polyoxyethylene sorbitan fatty acid esters (for example, polyoxyethylene sorbitan monolaurate, polyoxyethylene sorbitan monoolate, polyoxyethylene sorbitan triolate, etc.), polyoxyethylene sorbitol fatty acid esters (for example, tetraoleic acid polyoxyethylene sorbit, etc.), glycerin fatty acid esters (for example, glycerol monoolate, etc.), polyoxyethylene glycerin fatty acid esters (for example, monostearic acid polyoxyethylene glycerin, monooleic acid polyoxyethylene glycerin, etc.), polyoxyethylene fatty acid esters (polyethylene glycol monolaurate, polyethylene glycol monoolate, etc.), polyoxyethylenealkylamine acetylglycols (for example, 2, 4, 7, 9-tetramethyl-5-decin-4,7-diol, and ethylene oxide adducts of the diol as well as propylene oxide adducts thereof); and among these, polyoxyalkylenealkyl ethers are preferably used. The nonionic surfactants can be used in both of the first coating solution and the second coating solution. Moreover, one kind of the nonionic surfactants may be used alone, or two or more kinds of these may be used in combination.

With respect to the amphoteric surfactant, those of amino acid type, carboxy ammonium betaine type, ammonium sulfate betaine type, imidazolium betaine type, etc. may be used; for example, those described in the specifications of U.S. Pat. No. 3,843,368 and JP-A Nos. 59-49535, 63-236546, 5-303205, 8-262742 and 10-28261 are preferably used. With respect to the amphoteric surfactant, the amino acid type amphoteric surfactant is preferably used, and with respect to the amino acid type amphoteric surfactant, as described in Japanese Patent Application Laid-Open (JP-A) No. 5-303205, for example, those formed as derivatives from amid acid (glycine, glutamic acid, histidine acid, etc.) are listed, and examples thereof include N-amino acylic acid to which a long-chain acyl group is inserted and the salts thereof. One kind of the above-mentioned amphoteric surfactants may be used alone, or two or more kinds thereof may be used in combination.

With respect to the above-mentioned anionic surfactant, examples thereof include fatty acid salts (for example, stearic acid soda, potassium oleate), alkyl sulfate salts (for example, sodium lauryl sulfate and lauryl sulfate triethanol amine), sulfonic acid salt (for example, dodecylbenzenesodium sulfonate), alkylsulfosuccinic acid salt (for example, sodium dioctylsulfosuccinate), alkyldiphenyl ether disulfonic acid salt, alkyl phosphoric acid salt, etc.

With respect to the cationic surfactant, examples thereof include alkyl amine salt, the quaternary ammonium salt, pyridinium salt, imidazolium salt, etc.

With respect to the fluorine-based surfactant, examples thereof include compounds that are directed through an intermediate having a perfluoro alkyl group by using a method such as electrolytic fluorination, telomerization and oligomerization.

For example, perfluoroalkyl sulfonate, perfluoroalkyl carboxylate, perfluoroalkylethylene oxide adduct, perfluoroalkyltrialkyl ammonium salt, oligomer containing a perfluoroalkyl group and perfluoroalkyl phosphate are listed.

With respect to the above-mentioned silicon-based surfactant, silicon oil, which has been modified by an organic group, is preferably used, and may have a structure in which the side chain in a siloxane structure is modified by an organic group, a structure in which both of the terminals are modified, or a structure in which one of the terminals is modified. With respect to the organic group modification, examples thereof include an amino modification, a polyether modification, an epoxy modification, a carboxyl modification, a carbinol modification, an alkyl modification, an aralkyl modification, a phenol modification and a fluorine modification.

The content of the surfactant of the present invention is preferably set to 0.001 to 2.0%, more preferably, 0.01 to 1.0% with respect to the colorant-receiving layer coating solution. Moreover, in the case when two or more solutions are used as the coating solution for the colorant-receiving layer, the surfactant is preferably added to the respective coating solutions.

In the present invention, the colorant-receiving layer preferably contains a high-boiling-point organic solvent used to prevent curling. The high-boiling-point organic solvent is an organic compound having a boiling point of not less than 150° C. at normal pressure, and a water-soluble or hydrophobic compound. This may be provided as any form of liquid and solid at room temperature, and may be a low molecular substance or a high molecular substance.

Specific examples thereof include aromatic carboxylates (for example, dibutylphthalate, diphenylphthalate, phenylbenzoate, etc.), aliphatic carboxylates (for example, dioctyl adipate, dibutyl sebacate, methyl stearate, dibutyl maleate, dibutyl fumarate, triethylacetyl citrate, etc.), phosphates (for example, trioctyl phosphate, tricredyl phosphate), epoxyes (for example, epoxidized soybean oil, epoxidized fatty acid methyl, etc.) alcohols (for example, stearyl alcohol, ethylene glycol, propylene glycol, diethylene glycol, triethylene glycol, glycerin, diethylene glycol monobutyl ether (DEGMBE), triethylene glycol monobutyl ether, glycerin monomethyl ether, 1,2,3-butanetriol, 1,2,4-butanetriol, 1,2,4-pentanetriol, 1,2,6-hexane triol, thiodiglycol, triethanol amine, polyethylene glycol, etc.), plant oils (for example, soybean oil, sunflower seed oil, etc.) and higher aliphatic carboxylic acids (for example, linolic acid, oleic acid, etc.).

<Support>

With respect to the support of the present invention, a transparent support may be made from either of a transparent material such as plastic and a transparent material such as paper. In order to effectively use transparency of the colorant-receiving layer, it is preferable to use a transparent support or an opaque support having high gloss.

With respect to a material applicable to the transparent support, it is preferable to use a material having transparency and a resisting property to radiation heat imposed when it is used in an OHP and a backlight display. Examples of the material include polyesters such as polyethylene terephthalate (PET); polysulfone, polyphenyleneoxide, polyimide, polycarbonate, polyamide, etc. Among these, polyesters are more preferably used, and polyethyleneterephthalate is most preferably used.

Although not particularly limited, the thickness of the transparent support is preferably set to 50 to 200 μm from the viewpoint of easy handling.

With respect to the opaque support having high gloss, a material having high gloss, it is preferable to use a material having a glossiness of not less than 40% on its surface on the side on which the colorant-receiving layer is placed. The glossiness is a value found in accordance with a method described in JIS P-8142 (method of 75-degrees mirror-face glossiness-measurement on paper or card board). More specifically, the following supports are listed.

Examples thereof include paper support having high gloss such as art paper, coat paper, cast coat paper and baryta paper that is used for silver salt photographing-use support; films with high gloss that is made opaque by allowing a plastic film, such as polyesters like polyethylene terephthalate (PET), cellulose esters like nitrocellulose, cellulose acetate, cellulose acetate butylate, polysulfone, polyphenylene oxide, polyimide, polycarbonate and polyamide, to contain a white pigment, etc. (or may be subjected to a surface calender process); or a support formed by placing a polyolefin coating layer with or without a white pigment contained therein on the surface of each of the above-mentioned paper supports, each of the above-mentioned transparent supports or a film containing a white pigment, etc. and having high gloss.

Foamed polyester films containing white pigments (for example, foamed PET that is allowed to contain polyolefin fine particles and has voids formed through an expanding process) are also used. Moreover, resin coated paper used for silver salt photographing-use print paper is also used preferably.

Although not particularly limited, the thickness of the opaque support is preferably set in the range of 5 to 300 μm from the viewpoint of easy handling.

Moreover, in order to improve the wetability and adhering property, the surface of the above-mentioned support member may be subjected to processes such as a corona discharging process, a glow discharging process, a flame process and an ultraviolet irradiation process.

Next, the following description will discuss material paper used for the above-mentioned resin coat paper.

The material paper, which uses wood pulp as a main material, is produced by using synthetic pulp such as polypropylene or synthetic fibers such as nylon and polyester in addition to the wood pulp, on demand. With respect to the wood pulp, any of LBKP, LBSP, NBKP, NBSP, LDP, NDP, LUKP and NUKP may be used; however, LBKP, NBSP, LBSP, NDP and LDP, which contain more short fibers, are preferably used in a greater amount.

Here, the rate of the LBS and/or LDP is preferably set in the range of not less than 10 mass % to more than 70 mass %.

With respect to the above-mentioned pulp, chemical pulps (such as sulfate pulp and sulfite pulp) containing less impurity are preferably used, and pulps that are subjected to a bleaching process to have an improved whiteness degree are also effectively used.

To the material paper are appropriately added the following agents: a sizing agent such as higher fatty acid and alkyl ketene dimmer, a white pigment such as calcium carbonate, talc and titanium oxide, a paper-strength increasing agent such as starch, polyacryl amide and polyvinyl alcohol, a fluorescent whitening agent, a moisture holding agent such as polyethylene glycol, a dispersing agent, and a softening agent such as quaternary ammonium.

With respect to the freeness of pulp used for thread paper, it is preferably set in the range of 200 to 500 ml in conformity with the standard of CSF, and with respect to the fiber length after the beating process, the sum of the mass % of 24 mesh residue and the mass % of 42 mesh residue, which is stipulated by JIS P-8207, is preferably set in the range of 30 to 70%. Here, the mass % of 4 mesh residue is preferably set to not more than 20 mass %.

The basis weight of the paper material is preferably set in the range of 30 to 250 g, more preferably, 50 to 200 g. The thickness of the paper material is preferably set in the range of 40 to 250 μm. The paper material may be subjected to a calender process during the threading process or after the threading process so as to provide high smoothness. The density of the paper material is generally set in the range of 0.7 to 1.2 g/m$^2$ (JIS P-8118).

Moreover, the degree of stiffness of the paper material is preferably set in the range of 20 to 200 g under conditions stipulated by JIS P-8143.

The surface of the paper material may be coated with a surface sizing agent, and with respect to the surface sizing agent, the same sizing agent as added to the above-mentioned paper material may be used.

The pH of the paper material is preferably set in the range of 5 to 9 when measured by a hot-water extracting method stipulated by JIS P-8 113.

Polyethylene to be used for coating the surface and rear surface of the paper material is mainly low-density polyethylene (LDPE) and/or high-density polyethylene (HDPE); however, another material such as linear-low-density polyethylene (LLDPE) and polypropylene may be partially used.

In particular, with respect to the polyethylene layer on the side on which the colorant-receiving layer is formed, as has been widely carried out in photographing print paper, preferably, rutile-type or anatase-titanium dioxide, fluorescent bleaching agent and ultramarine blue are added to polyethylene so that the opacity, whiteness degree and hue are improved. Here, with respect to the content of titanium oxide, it is preferably set to approximately 3 to 20 mass %, more preferably, 4 to 13 mass %. Although not particularly limited, the thickness of the polyethylene layer is preferably set to 10 to 50 μm. Moreover, an undercoat layer may be formed on the polyethylene layer so as to improve the adhering property to the colorant-receiving layer. With respect to the under coating layer, aqueous polyester, gelatin and PVA are preferably used. Here, the thickness of the under coating layer is preferably set to 0.01 to 5 μm.

The polyethylene coat paper may be used as gloss paper, or a so-called pattern-forming process may be carried out when polyethylene is melted and extruded onto the paper material so as to be coated; thus, mat-like surface or silk-like surface may be formed in the same manner as those obtained in normal photographing print paper.

A back coat layer may be formed on the support, and with respect to components to be applied to this back coat layer, examples thereof include white pigments, aqueous binders, etc.

With respect to the white pigments to be contained in the back coat layer, examples thereof include white inorganic pigments, such as light duty calcium carbonate, heavy duty calcium carbonate, kaolin, talc, calcium sulfate, barium sulfate, titanium dioxide, zinc oxide, zinc sulfate, zinc carbonate, satin white, aluminum silicate, diatomaceous earth, calcium silicate, magnesium silicate, synthetic amorphous silica, colloidal silica, colloidal alumina, pseudo-boehmite, aluminum hydroxide, alumina, lithopone, zeolite, hydro-halloysite, magnesium carbonate and magnesium hydroxide, and organic pigments, such as styrene plastic pigments, acrylic plastic pigments, polyethylene, microcapsules, urea resins and melamine resins.

With respect to aqueous binders applied to the back coat layer, examples thereof include water soluble polymers, such as styrene/maleate copolymer, styrene/acrylate copolymer, polyvinyl alcohols, silanol modified polyvinyl alcohol, starch, cationic starch, casein, gelatin, carboxymethylcellulose, hydroxyethylcellulose and polyvinyl pyrrolidone, water dispersing polymers such as styrenebutadiene latex and acrylic emulsions.

With respect to other components contained in the back coat layer, examples thereof include antifoaming agents, foam-suppression agents, dyes, fluorescent bleaching agents, antiseptic agents, water-resisting agents, etc. (Formation of an inkjet recording sheet)

In the inkjet recording sheet of the present invention, the colorant-receiving layer is preferably formed as follows: a first coating solution (hereinafter, sometimes referred to as "coating solution (A)") containing at least fine particles and a water soluble resin is applied to, for example, the surface of a support, and after having applied thereto a second coating solution (hereinafter, sometimes referred to as "coating solution (B)") having at least a mordant with the pH value being set to not less than 8, (1) simultaneously with the coating process of the coating solution or (2) during a drying process of the coat layer formed by applying the coating solution before the coat layer comes to have decreasing rate of drying, the coat layer to which the second coating solution has been applied is cross-linked and cured (Wet-on-Wet method).

In this case, (A) at least one compound selected from the group consisting of compounds represented by the above-mentioned formulas (1) to (4) and which has either or both of an I/O value of at least 0.5 and water soluble property is preferably contained in at least either the coating solution (A) or the coating solution (B). Further, the cross-linking agent capable of cross-linking the above-mentioned water soluble resin is preferably contained in at least either the coating solution (A) or the coating solution (B).

The colorant-receiving layer that has been cross-linked and cured in this manner is preferably used from the viewpoint of the ink absorbing property and prevention of cracking in the film.

The above-mentioned processes allow more mordant to be located in the vicinity of the surface of the colorant-receiving layer; therefore, the color material of the inkjet is sufficiently mordanted so that the water resisting property of characters and images after having been printed is preferably improved. One portion of the mordant may be contained in the above-mentioned coating solution (A), and in this case, the mordants of the coating solution (A) and the coating solution (B) may be the same or different.

In the present invention, the coating solution for the colorant-receiving layer (coating solution (A)) containing at least the above-mentioned fine particles (for example, silica of the gaseous phase method) and the above-mentioned water soluble resin (for example, polyvinyl alcohol) may be prepared, for example, in the following method:

Silica fine particles of the gaseous phase method and a dispersant are added to water (for example, the silica fine particles in water are set to 10 to 20 mass %), and this is dispersed under a high-speed rotation, for example, at 10000 rpm (preferably, 500 to 20000 rpm), for about 20 minutes (preferably, 10 to 30 minutes) by using a high-speed wet-type colloidal mill (for example, "Crearmix made by M-Technique (K.K)), and to this is further added a water solution containing a cross-linking agent (boron compound) and polyvinyl alcohol (PVA) (so as to set PVA to approximately ⅓ of the mass of the silica of the gaseous phase method). Further, when (A) at least one compound selected from the group consisting of compounds represented by the above-mentioned formulas (1) to (4), and set to have a water soluble property of the present invention is contained in the coating solution for the colorant-receiving layer, the above-mentioned compound is added thereto and dispersed under the same rotation conditions as described above; thus, the coating solution is prepared. The resulting coating solution is set to an even sol state, and this is applied onto the support by using the following coating method, and dried so that it is possible to form a porous colorant-receiving layer having a three-dimensional mesh structure.

Moreover, the water dispersed matter composed of the above-mentioned silica of the gaseous phase method and dispersant is prepared by any one of the following methods: a water dispersing solution of silica of the gaseous phase method is preliminarily prepared, and this is added to a dispersant water solution; the dispersant water solution is added to the water dispersing solution of silica of the gaseous phase method, or the mixing processes are carried out simultaneously. Alternatively, by using not the water dispersing solution of silica of the gaseous phase method but a power silica of the gaseous phase method is used, and this may be added to the dispersant water solution as described above.

After the silica of the gaseous phase method and the dispersant have been mixed, the mixed solution is allowed to have fine particles by using a dispersing device; thus, a water dispersing solution having the average particle size of 50 to 300 nm. With respect to the dispersing device used for obtaining the water dispersing solution, the various conventionally known devices, such as a high-speed rotary dispersing device, a medium stirring type dispersing device (ball mill, sand mill, etc.), an ultrasonic wave dispersing device, a colloid mill dispersing device and a high pressure dispersing device, can be used; however, from the viewpoint of efficient dispersion of aggregated fine particles sometimes formed, a stirring type dispersing device, a colloid mill dispersing device or a high-pressure dispersing device is preferably used.

Moreover, with respect to solvents used in the respective processes, water, an organic solvent, or a mixed solvent of these may be used. With respect to the organic solvents applicable to this coating process, examples thereof include alcohols, such as methanol, ethanol, n-propanol, i-propanol and methoxypropanol, ketones such as acetone and methylethylketone, tetrahydrofran, acetonitrile, ethylacetate, toluene, etc.

Moreover, with respect to the above-mentioned dispersant, cationic polymers may be used. With respect to the cationic polymers, the same examples as the above-mentioned mordant may be listed. Moreover, a silane coupling agent is also preferably used as the dispersant. The addition of the above-mentioned dispersant to the fine particles is preferably set to 0.1% to 30%, more preferably, 1% to 10%.

The coating process of the coating solution onto the above-mentioned colorant-receiving layer is carried out by using known coating methods such as an extrusion die coater, an air doctorcoater, a blade coater, a rod coater, a knife coater, a squeeze coater, a reverse roll coater and a bar coater.

The coating solution (B) is applied to the coat layer simultaneously with the application of the coating solution for the colorant-receiving layer (coating solution (A)) or after the application thereof; however, the coating solution (B) may be applied thereto before the coat layer having subjected to the coating process comes to have decreasing rate of drying. In other words, after the coating process of the coating solution for the colorant-receiving layer (coating solution (A)), the mordant is introduced thereto while the coat layer exhibits a constant rate of drying so that it is possible to carry out a preferable preparing process.

Here, the above-mentioned expression "before the coat layer comes to have decreasing rate of drying" normally refers to a process in several minutes immediately after the coating process of the coating solution for the colorant-receiving layer, and during this period, the content of the solvent (dispersing medium) in the coat layer having been subjected to the coating process decreases in proportion to time "at a constant rate of drying". With respect to the time during which this "constant rate of drying" is maintained, the corresponding description is found in, for example, Chemical Engineering Hand Book (pages 707 to 712, published by Maruzen (K.K.) on Oct. 25, 1980).

As described above, the drying process is carried out until, after the coating process of the first coating solution, the coat layer has come to exhibit a decreasing rate of drying, and the drying process is generally carried out at 50 to 180° C. for 5 to 10 minutes (more preferably, 0.5 to 5 minutes). This drying time of course varies depending on the amount of coat; however, in general, it is properly set in the above-mentioned range.

With respect to the method of addition prior to the state of a decreasing rate of drying of the first coat layer, for example, the following methods are listed: (1) a method of further applying the coating solution (B) to the coat layer, (2) a method of atomizing the solution through a spraying process and (3) a method of immersing the support having the coat layer formed thereon into the coating solution (B).

In the above-mentioned method (1), with respect to the coating method for applying the coating solution (B), it is possible to use known coating methods such as a curtain flow coater, an extrusion die coater, an air doctor coater, a blade coater, a rod coater, a knife coater, a squeeze coater, a reverse roll coater and a bar coater. Here, it is preferable to use a method in which the coater is not directly in contact with the first coat layer that has been already formed, such as an extrusion die coater, a curtain flow coater and a bar coater.

After the application of the mordant solution (coating solution (B)), in general, this is heated at 40 to 180° C. for 0.5 to 30 minutes so as to be dried and cured. In particular, it is preferable to heat at 40 to 150° C. for 1 to 20 minutes.

Moreover, in the case when the above-mentioned mordant solution (coating solution (B)) is applied simultaneously with the coating process of the coating solution for the colorant-receiving layer (coating solution (A)), the coating solution for the colorant-receiving layer (coating solution (A)) and the mordant solution (coating solution (B)) are simultaneously applied (multiple layer coating) on the support with the coating solution for the colorant-receiving layer (coating solution (A)) being in contact with the support, and this is then dried and cured to firm a colorant-receiving layer.

The above-mentioned simultaneous coating (multiple layer coating) process may be carried out by a coating method using an extrusion die coater or a curtain flow coater. After the simultaneous coating process, the coat layer thus formed is dried, and in this case, in general, the coat layer is heated at 40 to 150° C. for 0.5 to 10 minutes, more preferably, at 40 to 100° C. for 0.5 to 5 minutes.

In the case when, for example, the above-mentioned simultaneous coating process (multiple layer coating) is carried out by an extrusion die coater, the two kinds of coating solutions, simultaneously discharged, are formed into superposed layers before being transferred to the support, and in this state, applied onto the support as superposed layers. The two layers of coating solutions that have been superposed prior to the application tend to cause a cross-linking reaction on the interface between the two solutions when transferred onto the support, with the result that the discharging two solutions are mixed in the vicinity of the discharging outlet of the extrusion die coater to have an increased viscosity, causing a problem with the coating operation. Therefore, in the case of the above-mentioned simultaneous coating process, a barrier layer solution (intermediate layer solution) is preferably interposed between the above-mentioned two solutions simultaneously with the coating process of the coating solution for the colorant-receiving layer (coating solution (A)) and the mordant solution (coating solution (B)), and the coating process is preferably carried out with triple layers being superposed.

Not particularly limited, the above-mentioned barrier layer solution is desirably selected. Examples thereof include a solution slightly containing a water soluble resin, and water. The above-mentioned water soluble resin is used as a viscosity-increasing agent so as to improve the coating property; and examples thereof include polymers such as cellulose resins (for example, hydroxypropylmethyl cellulose, methyl cellulose, hydroxyethylmethyl cellulose, etc.), polyvinyl pyrrolidone and gelatin. Here, the barrier layer solution may contain the above-mentioned mordant.

After the colorant-receiving layer has been formed on the support, the colorant-receiving layer is subjected to a calender process through a roll nip under applied heat and applied pressure by using, for example, a super calender, a gross calender, etc. so that it becomes possible to improve the surface smoothness, glossiness, transparency and coat film strength. However, since the calender process tends to cause a reduction in the porosity (that is, since the ink absorbing property tends to be lowered), it is necessary to set a condition that is less susceptible to reduction in the porosity.

With respect to the roll temperature in the case of the application of the calender process, it is preferably set to 30 to 150° C., more preferably, 40 to 100° C.

Moreover, with respect to the line pressure between the rolls at the time of the calender process, it is preferably set to 50 to 400 kg/cm, more preferably, 100 to 200 kg/cm.

With respect to the layer thickness of the colorant-receiving layer, in the case of the inkjet recording, since it is necessary to provide an absorbing capacity that can absorb all the droplets, the layer thickness needs to be determined in association with the porosity in the layer. For example, supposing that the amount of ink is 8 $nL/mm^2$ with a porosity of 60%, the layer thickness needs to be set to approximately not less than 15 μm.

Taking this point into consideration, the layer thickness of the colorant-receiving layer is preferably set in the range of 10 to 50 μm in the case of the inkjet recording process.

Moreover, the fine pore diameter of the colorant-receiving layer is preferably set to 0.005 to 0.030 μm, more preferably, 0.01 to 0.25 μm in the median diameter.

The above-mentioned porosity and the fine pore median diameter may be measured by using a mercury porosimeter (trade name "Bore Sizer 9320-PC2" made by Shimadzu Corporation).

Moreover, the colorant-receiving layer is preferably designed to have superior transparency, and with respect to the degree of this property, when the colorant-receiving layer is formed on a transparent film support, its haze value is preferably set to not more than 30%, more preferably, not more than 20%.

The above-mentioned Haze Value May be Measured by a Haze Meter (HGM-2DP: made by Suga Test Instrument Co. Ltd.).

A polymer fine particles dispersing substance may be added to a composition layer of an inkjet recording sheet of the present invention (for example, a colorant-receiving layer, or a back layer, etc.). This polymer fine particles dispersing substance is used for improving various film properties such as size stability, curl preventing property, anti-adhering property, cracking prevention property, etc. With respect to the polymer fine particles dispersing substance, the corresponding descriptions are found in JP-A No. 62-245258, 62-1316648 and 62-110066.

Here, when a polymer fine particles dispersing substance having a low glass transition temperature (not more than 40° C.) is added to a layer containing the above-mentioned mordant, it becomes possible to prevent cracking and curling in the layer. Moreover, when a polymer fine particles dispersing substance having a high glass transition temperature is added to a back layer, it is also possible to prevent curling.

Moreover, the inkjet recording sheet of the present invention may be manufactured by using methods disclosed in the following JP-A Nos. 10-81064, 10-119423, 10-157277, 10-217601, 11-348409, 2001-138621, 2000-43401, 2000-211235, 2000-309157, 2001-96897, 2001-138627, 11-91242, 8-2087, 8-2090, 8-2091 and 8-2093.

EXAMPLES

Referring to examples, the following description will explain the present invention in detail; however, the present invention is not intended to be limited thereby. Here, in the following examples, "part" and "%" represent "mass part" and "mass %", unless otherwise specified, and "average molecular weight" and "polymerization degree" represent "mass average molecular weight" and "mass average polymerization degree".

Example 1

<Preparation of Support>

Wood pulp made from 100 parts of LBKP is beat to 300 ml in the Canadian freeness by a double disk refiner, and to this are added 0.5 parts of epoxidated behenic acid amide, 1.0 part of anion polyacrylamide, 0.1 part of polyamide-polyamine epichlorohydrin and 0.5 parts of cation polyacrylamide, each being added in the absolute mass ratio with respect to the pulp, and this is weighed by a long net threading device to provide 170 $g/m^2$ of threaded paper material.

In order to adjust the surface size of the paper material, 0.04% of a fluorescent bleaching agent ("Whitex BB" made by Sumitomo Chemical Co., Ltd.) is added to a 4% water solution of polyvinyl alcohol, and into this is immersed the above-mentioned paper material to be set to 0.5 $g/m^2$ in the absolute mass conversion, and dried, and this is further subjected to a calender process to obtain base paper having an adjusted density of 1.05 g/ cc.

A corona discharging process was carried out on a wire surface (rear face) side of the resulting base paper, and this was coated with high-density polyethylene by using a melt extruder to have a thickness of 19 μm so that a resin layer having a mat surface was formed (hereinafter, the resin layer face is referred to as "rear face"). The resin layer on the rear face side was further subjected to a corona discharging process, and a dispersing solution, which was prepared by dispersing aluminum oxide ("Alumina Sol 100 made by Nissan Chemical Industries, Ltd.) and silicon dioxide ("Snowtex O" made by Nissan Chemical Industries, Ltd.), serving as antistatic agents, into water at a mass ratio of 1:2, was applied thereto so as to be set at 0.2 $g/m^2$ in the dried mass.

Moreover, a corona discharging process was carried out on the felt face (surface) side, that is, the side without the resin layer, and onto this side, low density polyethylene, which contained 10% of anatase-type titanium dioxide, a slight amount of ultramarine blue and 0.01% (to polyethylene) of a fluorescent beaching agent, and had an MFR (Melt Flow Rate) of 3.8, was then extruded so as to have a thickness of 29 μm by using a melt extruder so that a thermoplastic resin layer having high gloss was formed on the surface side of the base paper (hereinafter, this surface having high gloss is referred to as "front surface"; thus a support was formed.

<Preparation of Coating Solution A for Colorant-receiving Layer>

(1) Silica fine particles of the gaseous phase method, (2) ion exchange water and (3) "PAS-M-1" in the following composition were mixed, and dispersed at 10000 rpm in the rotation number for 20 minutes by using a high-speed rotary-type colloid mill ("Crearmix" made by M technique Co., Ltd.), and to this was added a solution containing (4) polyvinyl alcohol, (5) boric acid, (6) polyoxyethylenelauryl ether and (7) ion exchange water, and this was further dispersed at 10000 rpm in the rotation number for 20 minutes so that a coating solution A for colorant-receiving layer was prepared.

The mass ratio (PB ratio=(1): (4)) of the silica fine particles and the water soluble resin was set to 4.5:1, and the pH of the coating solution A for colorant-receiving layer was set to 3.5, which was acidic.

| Composition of coating solution A for colorant-receiving layer | |
|---|---|
| (1) Silica fine particles of the gaseous phase method (inorganic fine particles) ("Reolosil QS 30" made by Tokuyama Corp., average primary particle size: 7 nm) | 10.0 parts |
| (2) Ion exchange water | 51.7 parts |
| (3) "PAS-M-1" (60% water solution) (dispersant, made by Nittobo (K. K.) | 0.83 parts |
| (4) Polyvinyl alcohol (water soluble resin) 8% water solution ("PVA124" made by Kuraray Co., Ltd., degree of saponification: 98.5%, polymerization degree 2400) | 27.8 parts |
| (5) Boric acid (cross-linking agent) | 0.4 parts |
| (6) Polyoxyethylenelauryl ether (surfactant) ("Emulgen 109P"(10% water solution), made by Kao Corporation, HLB value: 13.6) | 1.2 parts |
| (7) Ion exchange water | 33.0 parts |

<Preparation of Inkjet Recording Sheet>

After a corona discharging process had been carried out on the front face of the above-mentioned support, the coating solution A for colorant-receiving layer obtained from the above-mentioned processes was applied on the front face of the support by using an extrusion die coater at an amount of coat of 200 ml/m$^2$ (coating process), and this was dried at 80° C. (at a wind speed of 3 to 8 m/sec.) by a hot-air drying device until the solid component concentration of the coat layer had reached 20%. During this period, this coat layer exhibited a constant rate of drying. Immediately after this process, this was immersed in a mordant solution B having the following composition for 30 seconds so that 20 g/m$^2$ thereof was deposited on the coat layer (process for applying the mordant solution), and this was then further dried at 80° C. for 10 minutes (drying process). Thus, an inkjet recording sheet (1) of the present invention on which a colorant-receiving layer having a dried film thickness of 32 μm was prepared.

| Composition of mordant coating solution B | |
|---|---|
| (1) Boric acid (cross-linking agent) | 0.65 parts |
| (2) Polyallylamine "PAA-10C" 10% solution (Mordant made by Nittobo (K. K.)) | 25 parts |
| (3) Exemplified compound 1-16 (compound of the present invention) | 2.5 parts |
| (4) Ion exchange water | 59.7 parts |
| (5) Ammonium chloride (surface pH adjusting agent) | 0.8 parts |
| (6) Polyoxyethylenelauryl ether (surfactant) ("Emulgen 109P"(2% water solution), made by Kao Corporation, HLB value: 13.6) | 10 parts |
| (7) Megafac "F1405" 10% water solution | 2.0 parts |

(fluorine-based surfactant made by Dainippon Ink and Chemicals, Incorporated)

Example 2

The same processes as example 1 were carried out except that exemplified compound 1-16 in mordant coating solution B of example 1 was changed to exemplified compound 1–18 to prepare inkjet recording sheets. Table 1 shows the results.

Example 3

The same processes as example 1 were carried out except that exemplified compound 1–16 in mordant coating solution B of example 1 was changed to exemplified compound 1–22 to prepare inkjet recording sheets. Table 1 shows the results.

Example 4

The same processes as example 1 were carried out except that exemplified compound 1–16 in mordant coating solution B of example 1 was changed to exemplified compound 1–76 to prepare inkjet recording sheets. Table 1 shows the results.

Example 5

The same processes as example 1 were carried out except that exemplified compound 1–16 in mordant coating solution B of example 1 was changed to exemplified compounds 1–88 to prepare inkjet recording sheets. Table 1 shows the results.

Example 6

The same processes as example 1 were carried out except that exemplified compound 1–16 in mordant coating solution B of example 1 was changed to exemplified compounds 1–100 to prepare inkjet recording sheets. Table 1 shows the results.

Example 7

The same processes as example 1 were carried out except that polyallylamine "PAA-10C" 10% water solution in the mordant coating solution B of example 1 was changed to a water solution of 10 mass % of polyallylamine derivative 1 shown in the following composite example 1 to prepare inkjet recording sheets. Table 1 shows the results.

Composite Example 1

To 114.0 parts of 10 mass % water solution of polyallylamine (PAA-10C 10 mass % water solution) were added 2.7 parts of acrylonitrile and 0.1 parts of hydroquinonemonomethyl ether, and this was heated and stirred at room temperature for 8 hours, and water was added thereto so as to adjust the concentration; thus, 10 mass % of water solution of polyallylamine derivative 1 (compound in which one portion of an amino group of polyallylamine was cyanoethylated) was obtained.

Example 8

The same processes as example 2 were carried out except that polyallylamine "PAA-10C" water solution (10%) in the mordant coating solution B of example 1 was changed to a water solution of 10 mass % of polyvinylamine (weight average molecular weight 70000) to prepare inkjet recording sheets. Table 1 shows the results.

Example 9

The same processes as example 1 were carried out except that 0.8 parts of ammonium chloride in the mordant coating solution B of example 1 was changed to 0.8 parts of ascorbic acid to prepare inkjet recording sheets. Table 1 shows the results.

Example 10

The same processes as example 1 were carried out except that 2.5 parts of thiourea was further added to the mordant coating solution B of example 1 to prepare inkjet recording sheets. Table 1 shows the results.

Example 11

The same processes as example 1 were carried out except that exemplified compound 1–16 in mordant coating solution B of example 1 was changed to exemplified compounds 1–4 to prepare inkjet recording sheets. Table 1 shows the results.

Comparative Example 1

The same processes as example 1 were carried out except that exemplified compound 1–16 in mordant coating solution B of example 1 was changed to hydroquinone to prepare inkjet recording sheets. Table 1 shows the results.

Comparative Example 2

The same processes as example 1 were carried out except that exemplified compound 1–16 in mordant coating solution B of example 1 was changed to p-phenylenediamine to prepare inkjet recording sheets. Table 1 shows the results.

Comparative Example 3

The same processes as example 1 were carried out except that 25 parts of water solution of polyallylamine PAA-10C (10%) in mordant coating solution B of example 1 was changed to 25 parts of 10% water solution of poly(N-(vinylbenzyl)triethyl ammonium chloride) to prepare inkjet recording sheets. Table 1 shows the results.

Comparative Example 4

The same processes as example 1 were carried out except that 25 parts of water solution of polyallylamine PAA-10C (10%) in mordant coating solution B of example 1 was changed to 12.5 parts of 20% water solution of diallylamine hydrochloride/sulfur dioxide copolymer (PAS-92 made by Nittobo (K.K.)) and 47.8 parts of ion exchange water was also changed to 60.3 parts to prepare inkjet recording sheets. Table 1 shows the results.

Comparative Example 5

The same processes as example 1 were carried out except that exemplified compound 1–16 in mordant coating solution B of example 1 was changed to dilauryl 3,3'-thiodipropionate (low-polarity thioether) to prepare inkjet recording sheets. Table 1 shows the results.

Comparative Example 6

The same processes as example 1 were carried out except that none of exemplified compound 1–16 in mordant coating solution B of example 1 was added, thereby preparing inkjet recording sheets. Table 1 shows the results.

Measurements and Evaluation

<Ink-absorbing Rate>

An inkjet printer "PM-770C" made by Seiko Epson (K.K.) was used to print solid images of Y(yellow), M(magenta), C(cyan), K(black), B(blue), G(green) and R(red) on inkjet recording sheets obtained through the above-mentioned processes. Immediately after the printing process (approximately, 10 seconds later), paper was pressed to contact each of the images, and the presence or absence of ink transfer onto the paper was visually observed, and evaluation was made in accordance with the following criteria. When no transfer of ink onto the paper was observed, this indicates that superior ink absorbing rate is achieved.

[Evaluation Criteria]

AA . . . No ink transfer on the paper was observed.

BB . . . Ink transfer on the paper was partially observed.

CC . . . Ink transfer on the paper was considerably observed.

<Light Resisting Property>

After solid images of Y(yellow), M(magenta), C(cyan), K(black), B(blue), G(green) and R(red) had been printed on those sheets by using the same printer as described above, cycles, each consisting of a process in which the image is subjected to lamp irradiation for 3.8 hours by using a Xenon Weather-ometer "Ci65A|(made by ATLAS) under environmental conditions of 25° C. with relative humidity of 32% through a filter that cuts ultraviolet rays having wavelengths not more than 365 nm, and a process in which the resulting image was left under environmental conditions of 20° C. with relative humidity of 91% for one hour with the lamp being turned off, were repeated for 96 hours; thus, the degree of color fading of the respective color densities in the images were visually observed, and evaluated in according with the following criteria.

[Evaluation Criteria]

OO . . . Hardly any color fading was observed.

O . . . Color fading was slightly observed.

Δ. . . Considerable color fading was observed.

x . . . Extreme color fading was observed.

<Ozone Color Fading Test>

After solid images of Y(yellow), M(magenta), C(cyan), K(black), B(blue), G(green) and R(red) had been printed on those sheets by using the same printer as described above, images including a person and a scenery were further printed. After these had been left for 8 hours in an ozone atmosphere of a concentration of 3 ppm, the degree of fading of the respective colors and densities in the images were visually observed, and evaluated in according with the following criteria.

[Evaluation Criteria]

OO . . . Hardly any color fading was observed.

O . . . Color fading was slightly observed.

Δ. . . Considerable color fading was observed.

x . . . Extreme color fading was observed.

<Age-based Bleeding>

A lattice-shaped line pattern (line width 0.28 mm) with magenta ink and black ink being printed adjacent to each other was printed by using the same printer as described above. After this pattern thus printed had been left for three hours, it was further stored in a thermo-hygrostat at 40° C. with relative humidity of 90% for three days; then, the line width of the black color portions was observed under an optical microscope, and evaluated in accordance with the following criteria.

[Evaluation Criteria]

AA . . . Hardly any age-based bleeding was observed, providing a superior condition. (line width: 0.28 to 0.30 mm)

BB . . . Age-based bleeding was slightly observed; however, no problem was raised in practical use. (line width: 0.31 to 0.35 mm)

CC . . . Serious age-based bleeding was observed, and problems were raised in practical use. (line width: not less than 0.35 mm)

<Coloring>

Inkjet recording sheets prior to printing were visually observed with respect to whiteness degree of the colorant-receiving layer, and evaluated in accordance with the following criteria.

O . . . No coloring was observed on the colorant-receiving layer.

Δ. . . Coloring was slightly observed on the colorant-receiving layer.

x . . . Serious coloring was observed on the colorant-receiving layer.

<Coloring After Storage>

Inkjet recording sheets having been printed were placed in files, and these were subjected to a thermo process for three days, and then left under normal temperature and normal humidity (23° C., RH 65%) for three days. The whiteness degree of the paper surface that had been subjected to the above-mentioned processes was visually observed, and evaluated in accordance with the following criteria.

O . . . No coloring was observed on the colorant-receiving layer.

Δ. . . Coloring was slightly observed on the colorant-receiving layer.

x . . . Serious coloring was observed on the colorant-receiving layer.

The following table 1 shows the results of the above-mentioned evaluations.

TABLE 1

| | Ink absorption | Light resisting property | Ozone fading | Age-based bleeding | Coloring | Coloring after storage |
|---|---|---|---|---|---|---|
| Example 1 | AA | ○ | ○ | AA | ○ | ○ |
| Example 2 | AA | ○ | ○ | AA | ○ | ○ |
| Example 3 | AA | ○ | ○ | AA | ○ | ○ |
| Example 4 | AA | ○ | ○ | AA | ○ | ○ |
| Example 5 | AA | ○ | ○ | AA | ○ | ○ |
| Example 6 | AA | ○ | ○ | AA | ○ | Δ |
| Example 7 | AA | ○ | ○ | AA | ○ | ○ |
| Example 8 | AA | ○ | ○ | AA | ○ | ○ |
| Example 9 | AA | ○ | ○ | AA | ○ | ○ |
| Example 10 | AA | ○ | ○○ | AA | ○ | ○ |
| Example 11 | AA | ○ | ○ | AA | ○ | ○ |
| Comparative Example 1 | AA | ○ | ○ | BB | X | X |
| Comparative Example 2 | AA | ○ | ○ | BB | X | X |
| Comparative Example 3 | AA | Δ | Δ | CC | ○ | ○ |
| Comparative Example 4 | AA | Δ | Δ | BB | ○ | ○ |
| Comparative Example 5 | AA | Δ | Δ | AA | ○ | ○ |
| Comparative Example 6 | AA | X | X | AA | ○ | X |

The results of the above-mentioned table 1 show that the application of the compounds of the present invention provide a superior ink-absorbing property with high light-resisting property and ozone resisting property in the resulting images. In contrast, although good ozone resisting property was obtained, the compounds of comparative example 1 and comparative example 2 caused coloring on the paper surface, failing to provide image-receiving sheets that can be practically used. Moreover, in the case of combinations of organic mordants in comparative examples 3 and 4, it is confirmed that they are inferior in the improving effects of the light resisting property and ozone resisting property and in the prevention of age-based bleeding, in comparison with examples.

In accordance with the present invention it becomes possible to provide an inkjet recording sheet which has a firm structure that is less susceptible to cracks, etc., and surface smoothness and gloss on the recording surface, is provided with a superior ink-absorbing property without causing age-based bleeding, makes it possible to form an image with high resolution and high density, and is superior in image endurance such as light resisting property, water resisting property and ozone resisting property without causing coloring, etc. on the paper surface.

What is claimed is:

1. An inkjet recording sheet comprising a support and, on the support, a colorant-receiving layer including:

(A) at least one compound selected from the group consisting of compounds represented by the following formulas (1) to (4), the compound having an 110 value, which is an inorganic/organic ratio in an organic conceptual chart, of not less than 0.5; and (B) at least one organic mordant selected from the group consisting of polyallylamine, polyvinylamine and derivatives thereof:

$R^1—S—R^2$ General Formula (1)

$R^4—S—S—R^5$ General Formula (2)

$R^3—SH$ General Formula (3)

General Formula (4)

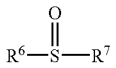

wherein, in formulas (1) to (4), each of $R^1$, $R^2$, $R^3$, $R^4$, $R^5$, $R^6$ and $R^7$ independently represents an optionally substituted alkyl group, an optionally substituted aryl group or an optionally substituted heterocyclic group, and any of pairs $R^1$ and $R^2$, $R^4$ and $R^5$, and $R^6$ and $R^7$ may be mutually coupled to form a ring.

2. An inkjet recording sheet comprising a support and, on the support, a colorant-receiving layer including:

(A) at least one compound selected from the group consisting of compounds represented by the following formulas (2) to (4), the compound being substantially water soluble; and (B) at least one organic mordant selected from the group consisting of polyallylamine, polyvinylamine and derivatives thereof:

$R^4—S—S—R^5$ General Formula (2)

$R^3—SH$ General Formula (3)

General Formula (4)

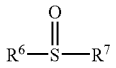

wherein, in formulas (2) to (4), each of $R^3$,$R^4$, $R^5$, $R^6$ and $R^7$ independently represents an optionally substituted alkyl group, an optionally substituted aryl group or an optionally substituted heterocyclic group, and any of pairs $R^4$ and $R^5$, and $R^6$ and $R^7$ may be mutually coupled to form a ring.

3. The inkjet recording sheet according to claim 1, wherein at least one of $R^1$ and $R^2$, at least one of $R^4$ and $R^5$, or at least one of $R^6$ and $R^7$ is substituted, the substituent including at least one substituent selected from the group consisting of a hydroxyl group, a carboxyl group, a carboxylate, an amino group, a sulfonic acid group and a sulfonate.

4. The inkjet recording sheet according to claim 2, wherein at least one of $R^1$ and $R^2$, at least one of $R^4$ and $R^5$, or at least one of $R^6$ and $R^7$ is substituted, the substituent including at least one substituent selected from the group consisting of a hydroxyl group, a carboxyl group, a carboxylate, an amino group, a sulfonic acid group and a sulfonate.

5. An inkjet recording sheet comprising a support and, on the support, a colorant-receiving layer including:

(A) at least one compound selected from the group consisting of compounds represented by the following formulas (1) to (4), the compound having an I/O value, which is an inorganic/organic ratio in an organic conceptual chart, of not less than 0.5; and (B) at least one organic mordant selected from the group consisting of polyallylamine, polyvinylamine and derivatives thereof:

$R^1—S—R^2$ General Formula (1)

$R^4—S—S—R^5$ General Formula (2)

$R^3—SH$ General Formula (3)

General Formula (4)

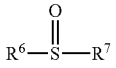

wherein, in formulas (1) to (4), each of $R^1$, $R^2$, $R^3$, $R^4$, $R^5$, $R^6$ and $R^7$ independently represents an optionally substituted alkyl group, an optionally substituted aryl group or an optionally substituted heterocyclic group, and any of pairs $R^1$ and $R^2$, $R^4$ and $R^5$, and $R^6$ and $R^7$ may be mutually coupled to form a ring, wherein the colorant-receiving layer further comprises at least one compound selected from the group consisting of compounds represented by the following formulas (5), (6) and (7) and compounds including an aliphatic carbon-carbon double bond group:

General Formula (5)

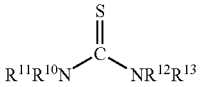

General Formula (6)

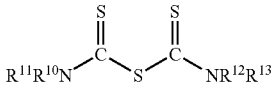

General Formula (7)

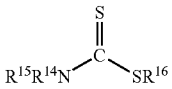

wherein: in formulas (5) and (6), each of $R^{10}$, $R^{11}$, $R^{12}$ and $R^{13}$ independently represents a hydrogen atom, an amino group, a substituted or unsubstituted alkyl group, a substituted or unsubstituted aryl group, an acyl group or an alkoxycarbonyl group, and any pair from $R^{10}$, $R^{11}$, $R^{12}$ and $R^{13}$ may be coupled to each other to form a ring; and in formula (7), each of $R^{14}$ and $R^{15}$ independently represents a hydrogen atom, a substituted or unsubstituted alkyl group, a substituted or unsubstituted aryl group, an acyl group or an alkoxycarbonyl group, $R^{16}$ represents a hydrogen atom, a substituted or unsubstituted alkyl group, a substituted or unsubstituted aryl group, a metal or quatemary ammonium, and any pair from $R^{14}$, $R^{15}$ and $R^{16}$ may be coupled to each other to form a ring.

6. An inkiet recording sheet comprising a support and, on the support, a colorant-receiving layer including:

(A) at least one compound selected from the group consisting of compounds represented by the following formulas (1) to (4), the compound being substantially water soluble; and (B) at least one organic mordant selected from the group consisting of polyallylamine, polyvinylamine and derivatives thereof:

$R^1—S—R^2$ General Formula (1)

$R^4—S—S—R^5$ General Formula (2)

$R^3—SH$ General Formula (3)

General Formula (4)

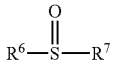

wherein, in formulas (1) to (4), each of $R^1$, $R^2$, $R^3$, $R^4$, $R^5$, $R^6$ and $R^7$ independently represents an optionally substituted alkyl group, an optionally substituted aryl group or an optionally substituted heterocyclic group, and any of pairs $R^1$ and $R^2$, $R^4$ and $R^5$, and $R^6$ and $R^7$ may be mutually coupled to form a ring, wherein the colorant-receiving layer further comprises at least one compound selected from the group consisting of compounds represented by the following formulas (5), (6) and (7) and compounds including an aliphatic carbon-carbon double bond group:

General Formula (5)

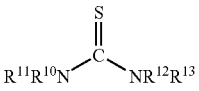

General Formula (6)

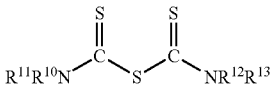

General Formula (7)

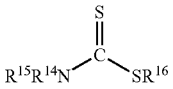

wherein: in formulas (5) and (6), each of $R^{10}$, $R^{11}$, $R^{12}$ and $R^{13}$ independently represents a hydrogen atom, an amino group, a substituted or unsubstituted alkyl group, a substituted or unsubstituted aryl group, an acyl group or an alkoxycarbonyl group, and any pair from $R^{10}$, $R^{11}$, $R^{12}$ and $R^{13}$ may be coupled to each other to form a ring; and in formula (7), each of $R^{14}$ and $R^{15}$ independently represents a hydrogen atom, a substituted or unsubstituted alkyl group, a substituted or unsubstituted aryl group, an acyl group or an alkoxycarbonyl group, $R^{16}$ represents a hydrogen atom, a substituted or unsubstituted alkyl group, a substituted or unsubstituted aryl group, a metal or quaternary ammonium, and any pair from $R^{14}$, $R^{15}$ and $R^{16}$ may be coupled to each other to form a ring.

7. The inkjet recording sheet according to claim 1, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

8. The inkjet recording sheet according to claim 2, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

9. The inkjet recording sheet according to claim 1, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

10. The inkjet recording sheet according to claim 2, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

11. The inkjet recording sheet according to claim 1, wherein the colorant-receiving layer further comprises fine particles, which include at least one selected from the group consisting of silica fine particles, colloidal silica, alumina fine particles and pseudo-boehmite.

12. The inkjet recording sheet according to claim 2, wherein the colorant-receiving layer further comprises fine particles, which include at least one selected from the group consisting of silica fine particles, colloidal silica, alumina fine particles and pseudo-boehmite.

13. The inkjet recording sheet according to claim 11, wherein the colorant-receiving layer comprises a layer formed by a process including the steps of:

coating a coating solution containing at least fine particles, the water soluble resin and the cross-linking agent, for forming a coated layer;

drying the coated layer; and cross-linking and curing the coated layer by applying a basic solution having a pH value of not less than 8 to the coated layer or a coating film, at least one time of (1) simultaneously with the step of coating the coating solution and (2) during the step of drying the coated layer, before the coated layer exhibits a decreasing rate of drying.

14. The inkjet recording sheet according to claim 12, wherein the colorant-receiving layer comprises a layer formed by a process including the steps of:

coating a coating solution containing at least fine particles, the water soluble resin and the cross-linking agent, for forming a coated layer;

drying the coated layer; and cross-linking and curing the coated layer by applying a basic solution having a pH value of not less than 8 to the coated layer or a coating film, at least one time of (1) simultaneously with the step of coating the coating solution and (2) during the step of drying the coated layer, before the coated layer exhibits a decreasing rate of drying.

15. An inkjet recording sheet comprising a support and, on the support, a colorant-receiving layer including at least one compound selected from the group consisting of thioether-based compounds represented by the following formula (8), the compound having an I/O value, which is an inorganic/organic ratio in an organic conceptual chart, of not less than 0.5:

$X—(Y^1—S)_m—(Y^2—S)_n—Y^3—X$ General Formula (8)

wherein, in the formula (8): X represents a hydroxyl group, a carboxyl group, a carboxylate, an amino group, or a group including at least one of these groups; $Y^1$, $Y^2$ and $Y^3$ each independently represents an alkylene group; n represents an integer from 1 to 6; and m represents 0 or 1.

16. An inkjet recording sheet comprising a support and, on the support, a colorant-receiving layer including at least one compound selected from the group consisting of thioether-based compounds represented by the following formula (8), the compound being substantially water soluble:

$$X—(Y^1—S)_m—(Y^2—S)_n—Y^3—X \qquad \text{General Formula (8)}$$

wherein, in the formula (8): X represents a hydroxyl group, a carboxyl group, a carboxylate, an amino group, or a group including at least one of these groups; $Y^1$, $Y^2$ and $Y^3$ each independently represents an alkylene group; n represents an integer from 1 to 6; and m represents 0 or 1.

17. The inkjet recording sheet according to claim 15, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

18. The inkjet recording sheet according to claim 16, wherein the colorant-receiving layer further comprises at least one acidic compound selected from the group consisting of halogenated hydroacid compounds, sulfuric acid compounds, nitric acid compounds, phosphoric acid compounds, sulfonic acid compounds, carboxylic acid compounds and boric acid compounds.

19. The inkjet recording sheet according to claim 15, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

20. The inkjet recording sheet according to claim 16, wherein the colorant-receiving layer further comprises a water soluble resin and a cross-linking agent capable of cross-linking the water soluble resin, the water soluble resin including at least one resin selected from the group consisting of polyvinyl alcohol-based resins, cellulose-based resins, resins including an ether bond, resins including a carbamoyl group, resins including a carboxyl group and gelatins.

21. The inkjet recording sheet according to claim 15, wherein the colorant-receiving layer further comprises fine particles, which include at least one selected from the group consisting of silica fine particles, colloidal silica, alumina fine particles and pseudo-boehmite.

22. The inkjet recording sheet according to claim 16, wherein the colorant-receiving layer further comprises fine particles, which include at least one selectedfrom the group consisting of silica fine particles, colloidal silica, alumina fine particles and pseudo-boehmite.

23. The inkjet recording sheet according to claim 21, wherein the colorant-receiving layer comprises a layer formed by a process including the steps of:

coating a coating solution containing at least fine particles, a water soluble resin and a cross-linking agent, for forming a coated layer;

drying the coated layer; and cross-linking and curing the coated layer by applying a basic solution having a pH value of not less than $^8$ to the coated layer or a coating film, at least one time of (1) simultaneously with the step of coating the coating solution and (2) during the step of drying the coated layer, before the coated layer exhibits a decreasing rate of drying.

24. The inkjet recording sheet according to claim 22, wherein the colorant-receiving layer comprises a layer formed by a process including the steps of:

coating a coating solution containing at least fine particles, a water soluble resin and a cross-linking agent, for forming a coated layer;

drying the coated layer; and cross-linking and curing the coated layer by applying a basic solution having a pH value of not less than 8 to the coated layer or a coating film, at least one time of (1) simultaneously with the step of coating the coating solution and (2) during the step of drying the coated layer, before the coated layer exhibits a decreasing rate of drying.

* * * * *